US008459886B2

(12) United States Patent
Furuki et al.

(10) Patent No.: US 8,459,886 B2
(45) Date of Patent: Jun. 11, 2013

(54) PRINTING METHOD AND DEVICE HAVING FIRST AND SECOND PRINTING UNITS

(75) Inventors: Ichirou Furuki, Tokyo (JP); Takaaki Kase, Tokyo (JP); Keiki Yamada, Tokyo (JP); Hisashi Yamada, Tokyo (JP); Makoto Sakuwa, Tokyo (JP); Yoshihito Matsuura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 975 days.

(21) Appl. No.: 11/920,743

(22) PCT Filed: Jul. 3, 2006

(86) PCT No.: PCT/JP2006/313226

§ 371 (c)(1),
(2), (4) Date: Nov. 20, 2007

(87) PCT Pub. No.: WO2007/013263

PCT Pub. Date: Feb. 1, 2007

(65) Prior Publication Data

US 2009/0116893 A1 May 7, 2009

(30) Foreign Application Priority Data

Jul. 27, 2005 (JP) ..... 2005-216970

(51) Int. Cl.
*B41J 11/70* (2006.01)
*B41J 11/42* (2006.01)
*B41M 7/00* (2006.01)

(52) U.S. Cl.
CPC ..... *B41J 11/703* (2013.01); *B41J 11/42* (2013.01); *B41M 7/0027* (2013.01); *B41J 2202/33* (2013.01)
USPC ..... 400/621; 400/611; 347/212

(58) Field of Classification Search
CPC ... B41J 11/703; B41J 11/70; B41J 11/42; B41J 1102/33
USPC ..... 400/621, 611; 347/212
See application file for complete search history.

(56) References Cited

U.S. PATENT DOCUMENTS 4,560,990 A * 12/1985 Sue et al. ..... 346/17

(Continued)

FOREIGN PATENT DOCUMENTS

JP 7-125270 A 5/1995
JP 11-300993 A 11/1999

(Continued)

*Primary Examiner* — Daniel J Colilla
(74) *Attorney, Agent, or Firm* — Birch, Stewart, Kolasch & Birch, LLP

(57) ABSTRACT

A first cutter 130 (cutting unit) is provided between a color recording unit 120 (the first printing unit) and an overcoat recording unit 140 (the second printing unit). A portion whereon color printing is completed by the color recording unit 120 of a recording paper 200 (printing medium) is cut off by the first cutter 130 and detached. An overcoat recording unit 140 performs an overcoat process on the detached recording paper (printing medium strip). In parallel with this, the color recording unit 120 performs next color printing on the recording paper 200. This makes it possible to reduce a printing time in a printing device including a plurality of printing processes without deteriorating printing quality. Further, an useless paper feeding is eliminated by optimally arranging the color recording unit 120, the first cutter 130, the overcoat recording unit 140, and the second cutter 160, etc. in accordance with a size of a printing area.

20 Claims, 24 Drawing Sheets

U.S. PATENT DOCUMENTS

| | | | | |
|---|---|---|---|---|
| 5,452,959 | A * | 9/1995 | Oka | 400/149 |
| 5,956,067 | A | 9/1999 | Isono et al. | |
| 2002/0075375 | A1* | 6/2002 | Yamakawa et al. | 347/221 |
| 2002/0171726 | A1* | 11/2002 | Ishii et al. | 347/101 |
| 2003/0019424 | A1* | 1/2003 | Takekoshi et al. | 118/258 |
| 2003/0234847 | A1* | 12/2003 | Takekoshi et al. | 347/102 |
| 2004/0165927 | A1* | 8/2004 | Fisher et al. | 400/621 |

FOREIGN PATENT DOCUMENTS

| | | | |
|---|---|---|---|
| JP | 11300993 | A * | 11/1999 |
| JP | 2000-052578 | A | 2/2000 |
| JP | 2000052578 | A * | 2/2000 |
| JP | 2003-054044 | A | 2/2003 |
| JP | 2003-266801 | A | 9/2003 |
| JP | 2004216732 | A * | 8/2004 |

* cited by examiner

PRINTING METHOD AND DEVICE HAVING FIRST AND SECOND PRINTING UNITS

TECHNICAL FIELD

The present invention relates to a printing device and a printing method by a plurality of printing steps.

BACKGROUND ART

Conventional printing devices include processes for performing printing in each primary color, wherein the primary colors (for example, three primary colors of yellow, magenta, cyan) constitute a color image and into which the color image is divided. Further, for example, there is a color thermal printer including a step for performing overcoat printing.

Conventionally, there is a printing device having a configuration for sequentially performing printing on a recording paper with one thermal head using one ink ribbon whereto four colors of Y (Yellow), M (Magenta), C (Cyan) and Overcoat (OP) are applied (Prior Art 1).

Further there is another printing device having a configuration wherein printing is performed in parallel by thermal heads provided one for each of two ink ribbons, one of which being applied Y, M and C, and the other being applied OP (Prior Art 2, i.e. Patent literature 1).

Patent literature 1: Japanese Unexamined Patent Publication No. 2000-052578

DISCLOSURE OF THE INVENTION

Problems to be Solved by the Invention

Prior Art 1 involves a problem that it takes much time in printing.

Prior Art 2 is more effective in reducing a printing time than Prior Art 1.

However, there is a problem that printing quality is liable to deterioration, such as unevenness of density, since printing is performed on a recording paper with two heads at a time and load variation generated at the time of driving one head is easily conducted to the other head.

It is one of the purposes of the present invention to solve the aforementioned problems, for example, and to reduce a printing time without deteriorating printing quality.

Means to Solve the Problems

There is provided according to one aspect of the present invention, a printing device for performing printing by a plurality of printing steps, the printing device including:

a first printing unit to perform printing by a first printing step on a printing medium;

a cutting unit to cut a portion on which the printing is performed by the first printing unit from the printing medium, as a printing medium strip; and a second printing unit to perform printing by a second printing step on the printing medium strip cut by the cutting unit.

The printing device further includes:

a first rotation unit to nip a printing medium, and to convey the printing medium nipped by rotating; and a second rotation unit to nip the printing medium, to nip a printing medium strip cut by the cutting unit from the printing medium nipped, and to convey the printing medium nipped and the printing medium strip nipped by rotating, wherein the first printing unit performs the printing by the first printing step on the printing medium conveyed by the first rotation unit, wherein the cutting unit cuts a portion on which the printing is performed by the first printing unit from the printing medium conveyed by the first rotation unit and the second rotation unit, as the printing medium strip, and wherein the second printing unit performs the printing by the second printing step on the printing medium strip cut by the cutting unit and conveyed by the second rotation unit.

In the printing device, a distance between a first printing position at which the first printing unit performs the printing on the printing medium and a cutting position at which the cutting unit cuts the printing medium is equal to a length of the printing medium from a fore-end of the printing medium to a point at which the first printing unit starts printing on the printing medium.

In the printing device, a distance between a cutting position at which the cutting unit cuts the printing medium and a second printing position at which the second printing unit performs the printing on the printing medium is equal to a length of the printing medium from a point at which the second printing unit starts printing on the printing medium to a point at which the cutting unit cuts the printing medium.

In the printing device, the second rotation unit nips the printing medium and the printing medium strip at a second printing position at which the second printing unit performs the printing on the printing medium.

The printing device further includes a third rotation unit to nip the printing medium at a third nip position, the third nip position being a prescribed position between a first printing position at which the first printing unit performs the printing on the printing medium and a cutting position at which the cutting unit cuts the printing medium strip from the printing medium, and to convey the printing medium nipped by rotating, wherein, by the third rotation unit nipping the printing medium nipped by the first rotation unit and stopping rotating, and by the first rotation unit rotating in a direction for conveying the printing medium, a slack is generated in the printing medium between the first printing position and the third nip position.

The printing device further includes a fourth rotation unit to nip the printing medium and the printing medium strip at a fourth nip position, the fourth nip position being a prescribed position between a cutting position at which the cutting unit cuts the printing medium strip from the printing medium and a second printing position at which the second printing unit performs the printing on the printing medium strip, and to convey the printing medium nipped and the printing medium strip nipped by rotating, wherein, by the second rotation unit nipping the printing medium nipped by the fourth rotation unit and stopping rotating, and by the fourth rotation unit rotating in a direction for conveying the printing medium, a slack is generated in the printing medium between the fourth nip position and the second printing position.

In the printing device, the first rotation unit conveys the printing medium to the first printing position, conveys the printing medium in a direction against a direction for conveying the printing medium after the first printing unit starts printing on the printing medium, and conveys the printing medium to a cutting position after the first printing unit completes the printing on the printing medium, and the second rotation unit nips the printing medium conveyed to the cutting position by the first rotation unit, and conveys the printing medium strip in a same direction as a direction for conveying the printing medium strip after the second printing unit starts printing on the printing medium strip cut by the cutting unit from the printing medium.

The printing device further includes a control unit to determine whether or not the printing on the printing medium is for a last one piece, wherein the first rotation unit, when the control unit determines that the printing on the printing medium is for the last one piece, conveys the printing medium to the second printing position after the first printing unit completes the printing on the printing medium, and when the control unit determines that the printing on the printing medium is not for the last one piece, conveys the printing medium to the cutting position after the first printing unit completes the printing on the printing medium, wherein the cutting unit cuts the printing medium strip from the printing medium when the control unit determines that the printing on the printing medium is not for the last one piece, and wherein the second rotation unit, when the control unit determines that the printing on the printing medium is for the last one piece, nips the printing medium conveyed to the second printing position by the first rotation unit, and conveys the printing medium in a same direction as a direction for conveying the printing medium after the second printing unit starts printing on the printing medium, and when the control unit determines that the printing on the printing medium is not for the last one piece, nips the printing medium conveyed to the cutting position by the first rotation unit, and conveys the printing medium strip in a same direction as a direction for conveying the printing medium strip after the second printing unit starts printing on the printing medium strip cut by the cutting unit from the printing medium.

The printing device further includes:

a third rotation unit to nip the printing medium at a third nip position, the third nip position being a prescribed position between a first printing position at which the first printing unit performs the printing on the printing medium and a cutting position at which the cutting unit cuts the printing medium strip from the printing medium, to convey the printing medium nipped by rotating, and to fix the printing medium nipped by stopping rotating; and a fourth rotation unit to nip the printing medium and the printing medium strip at a fourth nip position, the fourth nip position being a prescribed position between the cutting position at which the cutting unit cuts the printing medium strip from the printing medium and a second printing position at which the second printing unit performs the printing on the printing medium strip, to convey the printing medium nipped and the printing medium strip nipped by rotating, and to fix the printing medium nipped and the printing medium strip nipped by stopping rotating.

The printing device further includes:

a third rotation unit to nip the printing medium at a third nip position, the third nip position being a prescribed position between a first printing position at which the first printing unit performs the printing on the printing medium and a cutting position at which the cutting unit cuts the printing medium strip from the printing medium, and to convey the printing medium nipped by rotating; and a fourth rotation unit to nip the printing medium and the printing medium strip at a fourth nip position, the fourth nip position being a prescribed position between the cutting position at which the cutting unit cuts the printing medium strip from the printing medium and a second printing position at which the second printing unit performs the printing on the printing medium strip, and to convey the printing medium nipped and the printing medium strip nipped by rotating, wherein the third rotation unit and the fourth rotation unit, by rotating in a manner to convey the printing medium nipped by both the third rotation unit and the fourth rotation unit in opposite directions, fix the printing medium in a state under a prescribed tension.

The printing device further includes a margin cutting unit to cut a margin from the printing medium strip on which the printing is performed by the second printing unit.

The printing device performs the printing either on a recording paper or a roll paper.

In the printing device, the first printing unit performs a color printing.

In the printing device, the second printing unit performs an overcoat process.

In the printing device, the first printing unit performs the printing on the printing medium in parallel with the printing on the printing medium strip performed by the second printing unit.

The printing device further includes:

a main body of the printing device;

a first rotation unit to nip the printing medium between rollers rotatably fixed to the main body of the printing device, and to convey the printing medium by rotating the rollers; and a second rotation unit to nip the printing medium and the printing medium strip between rollers rotatably fixed to the main body of the printing device, and to convey the printing medium and the printing medium strip by rotating the rollers, wherein the first printing unit performs the printing on the printing medium at a prescribed position between a first nip position at which the first rotation unit nips the printing medium and a second nip position at which the second rotation unit nips the printing medium and the printing medium strip, wherein the cutting unit cuts the printing medium at a prescribed position between a first printing position at which the first printing unit performs the printing on the printing medium and the second nip position, and wherein the second printing unit performs the printing on the printing medium strip at a prescribed position between a cutting position at which the cutting unit cuts the printing medium and the second nip position.

The printing device further includes:

a third rotation unit to nip the printing medium between rollers rotatably fixed to the main body of the printing device between the first printing position and the cutting position, and to convey the printing medium by rotating the rollers; and a fourth rotation unit to nip the printing medium and the printing medium strip between rollers rotatably fixed to the main body of the printing device between a second printing position at which the second printing unit performs the printing on the printing medium strip and the cutting position, and to convey the printing medium and the printing medium strip by rotating the rollers.

The printing device further includes:

a main body of the printing device; and a first rotation unit to nip the printing medium between rollers rotatably fixed to the main body of the printing device, and to convey the printing medium by rotating the rollers, wherein the first printing unit performs the printing on the printing medium at a prescribed position between a first nip position at which the first rotation unit nips the printing medium and a second printing position at which the second printing unit performs the printing on the printing medium strip, wherein the cutting unit cuts the printing medium at a prescribed position between a first printing position at which the first printing unit performs the printing on the printing medium and the second printing position, and wherein the second printing unit further nips the printing medium and the printing medium strip between a printing head and a platen roller rotatably fixed to the main body of the printing device, and conveys the printing medium and the printing medium strip by rotating the platen roller.

The printing device further includes:

a third rotation unit to nip the printing medium between rollers rotatably fixed to the main body of the printing device between the first printing position and the cutting position, and to convey the printing medium by rotating the rollers; and a fourth rotation unit to nip the printing medium and the printing medium strip between rollers rotatably fixed to the main body of the printing device between the second printing position and the cutting position, and to convey the printing medium and the printing medium strip by rotating the rollers.

Further, there is provided according to another aspect of the present invention, a printing method of a printing device for performing a printing by a plurality of printing steps, the printing method including:

printing on a printing medium by a first printing unit;

cutting a portion on which the printing is performed by the first printing unit from the printing medium in the first printing step by a cutting unit, as a printing medium strip; and printing on the printing medium strip cut by the cutting unit by a second printing unit in parallel with the next printing on the printing medium performed by the first printing unit.

Effect of the Invention

According to the present invention, a first printing unit performs printing on a printing medium by a first printing step, and a cutting unit cuts a portion whereon printing is completed as a printing medium strip. Since the next printing is performed by the first printing unit in parallel with printing being performed by the second printing unit on the printing medium strip by a second printing step, printing times can be reduced. In this case, the first printing unit and the second printing unit do not conduct their printing loads to each other. Therefore, there is an effect that printing quality is not deteriorated. Further, there is an effect that the printing time can be reduced more by suitably arranging each unit.

PREFERRED EMBODIMENTS FOR CARRYING OUT THE INVENTION

Embodiment 1

The first embodiment is explained using FIG. 1 through FIG. 24.

FIG. 1 is a diagram describing one example of a structure of main parts of a printer 100 (one example of a printing device) according to the present embodiment.

In FIG. 1, the printer 100 includes a grip roller 115 (one example of the first rotation unit), a color recording unit 120 (one example of the first printing unit), a first cutter 130 (one example of a cutting unit), an overcoat recording unit 140 (one example of the second printing unit), a conveyance roller 155 (one example of the second rotation unit), a second cutter 160 (one example of a margin cutting unit), a paper-ejection roller 175, and a control unit 190.

The printer 100 houses a recording paper 200 (one example of a printing medium) wound up in a roll in an unshown recording paper housing unit.

The grip roller 115 includes two rollers, a lower roller fixed to a main body of the printer 100 in a manner rotatable in F-R direction, and an upper roller corresponding to the lower roller and rotatably fixed to the main body of the printer 100. The lower roller is connected to an unshown stepping motor (one example of a drive source), and is rotated by a drive force of the stepping motor. The lower roller is rotated for an arbitrary rotational angle by control of the control unit 190 over the stepping motor. Further, by keeping the stepping motor in an excitation state, it is possible to stop rotation of the lower roller and fix the lower roller. The upper roller can be freely rotated, which rotates corresponding to the rotation of the lower roller.

The grip roller 115 nips the recording paper 200 by holding the recording paper 200 at a nip position R1 between the upper roller and the lower roller. By rotating the grip roller 115 in F direction, the nipped recording paper 200 can be conveyed in A direction (paper-ejection direction). By rotating the grip roller 115 in R direction, the nipped recording paper 200 can be conveyed in B direction (recording-paper returning direction). The grip roller 115 can convey the recording paper 200 in either A direction or B direction at a fixed speed. Further, by stopping the rotation, it is possible to immovably fix the recording paper 200.

The color recording unit 120 includes a supply reel 121, a take-up reel 122, a thermal head 124 and a platen roller 125. The color recording unit 120 performs a color recording (printing) in Y (yellow), M (magenta) and C (cyan) on the recording paper 200 at a printing position P1.

The supply reel 121 and the take-up reel 122 are rotatably fixed to the color recording unit 120.

An ink sheet 320 is wound onto the supply reel 121 and the take-up reel 122. The ink sheet 320 supplied from the supply reel is wound onto the take-up reel 122 via the thermal head 124.

The supply reel 121 and the take-up reel 122 connect to an unshown driving device, and rotate by a drive force of the driving device.

Ink in three colors of Y, M and C is applied to the ink sheet 320. By control of the control unit 190 over the driving device, an arbitrary point on the ink sheet 320 is moved to the printing position P1, and printing is performed with ink in a desired color.

The thermal head 124 is fixed to the color recording unit 120 in a manner movable in D-D' direction. The thermal head 124 is moved by an unshown driving device. When performing printing, the thermal head 124 moves in D' direction to press against the recording paper 200. Meanwhile, when not performing printing, the thermal head 124 moves in D direction and is retracted from the recording paper 200.

The platen roller 125 is fixed to the main body of the printer 100 in a manner rotatable in F-R direction. The platen roller 125 is freely rotatable, and rotates corresponding to the move of the recording paper 200. The platen roller 125 holds the recording paper 200 from the reverse side when the thermal head 124 presses against the recording paper 200, which allows for stable printing.

The first cutter 130 has upper and lower two blades and cuts the recording paper 200 at a cutting position C1 under control of the control unit 190.

The overcoat recording unit 140 includes a supply reel 141, a take-up reel 142, a thermal head 144 and a platen roller 145. The overcoat recording unit 140 performs an overcoat process (printing) on an image formed (recorded or printed) by the color recording unit 120 at a printing position P2 on the recording paper 200.

The overcoat recording unit 140 is similar to the color recording unit 120 except that an overcoat ink is applied to an ink sheet 340 wound onto the supply reel 141 and the take-up reel 142.

A conveyance roller 155 (conveyance roller pair) includes two rollers, a lower roller fixed to the main body of the printer 100 in a manner rotatable in F-R direction, and an upper roller corresponding to the lower roller and rotatably fixed to the main body of the printer 100. The lower roller is connected to an unshown stepping motor, and is rotated by a drive force of the stepping motor. The lower roller is rotated for an arbitrary rotational angle by control of the control unit 190 over the stepping motor. Further, by keeping the stepping motor in an excitation state, it is possible to stop rotation of the lower roller and fix the lower roller. The upper roller can be freely rotated, and rotates corresponding to the rotation of the lower roller.

The conveyance roller 155 nips the recording paper 200 by holding the recording paper 200 at a nip position R2 between the upper roller and the lower roller. By rotating the conveyance roller 155 in F direction, the nipped recording paper 200 is conveyed in A direction. By rotating the conveyance roller 155 in R direction, the nipped recording paper 200 can be conveyed in B direction. Further, it is possible to immovably fix the recording paper 200 by stopping the rotation.

The second cutter 160 includes upper and lower two blades and cuts the recording paper 200 at a cutting position C2 under control of the control unit 190.

The paper-ejection roller 175 includes two rollers, a lower roller fixed to the main body of the printer 100 in a manner rotatable in F-R direction, and an upper roller corresponding to the lower roller and rotatably fixed to the main body of the printer 100. The lower roller is connected to an unshown stepping motor, and is rotated by a drive force of the stepping motor. The lower roller is rotated for an arbitrary rotational angle by control of the control unit 190 over the stepping motor. Further, it is possible to stop the rotation and fix the lower roller by keeping the stepping motor in an excitation state. The upper roller can be freely rotated, and rotates according to the rotation of the lower roller.

The paper-ejection roller 175 nips the recording paper 200 by holding the recording paper 200 between the upper roller and the lower roller. By rotating the paper-ejection roller 175 in F direction, the nipped recording paper 200 can be conveyed in A direction. By rotating the paper-ejection roller 175 in R direction, the nipped recording paper 200 can be conveyed in B direction. Further, it is possible to immovably fix the recording paper 200 by stopping the rotation.

Each of the units is arranged in order of the recording paper housing unit, the grip roller 115, the color recording unit 120, the first cutter 130, the overcoat recording unit 140, the conveyance roller 155, the second cutter 160, and the paper-ejection roller 175, in A direction.

Next, detailed explanations of operations at the time of printing are presented. Operations of the printer 100 are based on four steps of a color printing step, a cutting step, an overcoat process step, and a trimming step.

FIG. 2 is a flowchart describing one example of a flow of operations of the printer 100 in the color printing step according to the present embodiment.

The color printing step is a step for printing a color image on the printing paper 200.

In S501, the take-up reel 122 winds the ink sheet 320 thereon to orient its starting position to a point from which printing in Y (yellow) can be performed.

In S502, the grip roller 115 rotates in F direction to convey the recording paper 200 in A direction.

In S503, the control unit 190 determines whether or not the recording paper 200 reaches a printing starting position. When the recording paper 200 has not reached the printing starting position, S502 is repeated. When the recording paper 200 reaches the printing starting position, the flow proceeds to S504.

Various methods can be considered as methods for determining whether or not the recording paper 200 has reached the printing starting position. It is here assumed as an example that a position of the recording paper 200 is determined from a rotational amount (conveyance amount) of the stepping motor for driving the grip roller 115. That is, the position of the recording paper 200 is detected by managing (counting) pulse number of control signals in the stepping motor.

This is also the same in a case of adjusting the position of the recording paper 200 in each of the following steps.

In S504, the grip roller 115 stops to fix the recording paper 200.

In S505, an unshown driving device moves the thermal head 124 in D' direction to make the thermal head 124 press against the recording paper 200.

In S506, the thermal head 124 performs printing on the recording paper 200 while the grip roller 115 rotates in R direction (recording returning direction) to convey the recording paper 200 in B direction.

In S507, it is determined whether or not the recording paper 200 reaches a printing ending position. When the recording paper 200 has not reached the printing ending position, S506 is repeated. When the recording paper 200 reaches the printing ending position, the flow proceeds to S508.

In S508, the unshown driving device moves the thermal head 124 in D direction to be retracted from the recording paper 200.

In S509, it is determined whether or not printing is completed in three primary colors. When the printing in three primary colors is not completed, S501 through S508 are repeated.

When printing in Y (yellow) is completed, printing in M (magenta) is performed.

After printing in Y is completed, the ink sheet 320 is wound onto the take-up reel 122, and then in S501, is made to orient its starting position to a point from which printing in M can be performed.

When printing in M (magenta) is completed, printing in C (cyan) is finally performed.

After printing in C (cyan) is completed, the color printing step ends.

FIG. 3 is a flowchart describing one example of a flow of operations of the printer 100 in the cutting step according to the present embodiment.

The cutting step is a step for cutting off a portion whereon color printing is completed, from the recording paper 200.

In S601, the grip roller 115 rotates in F direction to convey the recording paper 200 in A direction.

At this time, the conveyance roller 155 also rotates in F direction simultaneously. This allows the conveyance roller 155 to nip the recording paper 200 when a fore-end of the printing paper 200 reaches the conveyance roller 155.

In S602, the control unit 190 determines whether or not the recording paper 200 reaches a cutting position. When the recording paper 200 has not reached the cutting position, S601 is repeated. When the recording paper 200 reaches the cutting position, the flow proceeds to S603.

In S603, the grip roller 115 and the conveyance roller 155 stop and fix the recording paper 200.

At this time, it is also possible to stop the conveyance roller 155 slightly later than the grip roller 115 to apply tension on the recording paper 200. This makes it possible to apply an appropriate tension on the recording paper 200, so that it becomes easier to cut the recording paper 200.

Further, at the same time, it is also possible to have the thermal heads 124 and 144 move in D' direction to press against the recording paper 200. This makes it possible to fix the recording paper 200 at a nearer position, so that it becomes easier to cut the recording paper 200.

In S604, the first cutter 130 is activated to cut the recording paper 200. This allows the recording paper 200 to be detached a fore-end portion (recording paper 201, as one example of a printing medium strip) whereon the color printing has been completed from an unprinted portion (recording paper 200).

FIG. 4 is a flowchart describing one example of a flow of operations of the printer 100 in the overcoat process step according to the present embodiment.

The overcoat process step is a step for printing with an overcoat ink on the recording paper 201 whereon the color printing has been completed.

In S701, the take-up reel. 142 winds the ink sheet 340 thereon to its starting position for printing.

Here, the ink sheet 340 is different from the ink sheet 320 in that it is applied only the overcoat ink, so that there is no need to strictly adjust the position of the ink sheet 340. Therefore, S701 can be omitted.

In S702, the conveyance roller 155 rotates in F direction to convey the recording paper 201 in A direction.

In S703, the control unit 190 determines whether or not the recording paper 201 reaches a printing starting position. When the recording paper 201 has not reached the printing starting position, S702 is repeated. When the recording paper 201 reaches the printing starting position, the flow proceeds to S704.

In S704, the conveyance roller 155 stops to fix the recording paper 201.

By suitably arranging the first cutter 130, the overcoat recording unit 140 and the conveyance roller 155, it is possible to locate the recording paper 201 at the time of cutting at the same position as a starting position of the overcoat process. In this case, S702 through S704 can be omitted.

In S705, the thermal head 144 moves in D' direction to press against the recording paper 201.

In S706, the thermal head 144 performs overcoat printing on the recording paper 201 while the conveyance roller 155 rotates in F direction to convey the recording paper 201 in A direction.

In S707, it is determined whether or not the recording paper 201 reaches a printing ending position. When the recording paper 201 has not reached the printing ending position, S506 is repeated. When the recording paper 201 reaches the printing ending position, the flow proceeds to S708.

In S708, the thermal head 144 moves in D direction to be retracted from the recording paper 201.

FIG. 5 is a flowchart describing one example of a flow of operations of the printer 100 in a trimming step according to the present embodiment.

The trimming step is a step for cutting an unnecessary part from the recording paper 201 whereon printing has been completed.

In S801, the conveyance roller 155 rotates in F direction to convey the recording paper 201 in A direction.

In S802, the control unit 190 determines whether or not the recording paper 201 reaches a fore-end trimming position. When the recording paper 201 has not reached the fore-end trimming position, S801 is repeated. When the recording paper 201 reaches the fore-end trimming position, the flow proceeds to S803.

In S803, the conveyance roller 155 stops to fix the recording paper 201.

By suitably arranging the overcoat recording unit 140, the conveyance roller 155 and the second cutter 160, it is possible to locate the recording paper 201 at the time of cutting at the same position as the starting position of overcoat process. In this case, S801 thorough S803 can be omitted.

In S804, the second cutter 160 is activated to cut off a margin at the fore-end of the recording paper 201.

In S805, the conveyance roller 155 rotates in F direction to convey the recording paper 201 in A direction.

At this time, the paper-ejection roller 175 also rotates in F direction simultaneously. This allows the paper-ejection roller 175 to nip the recording paper 201 when the fore-end of the recording paper 201 reaches the paper-ejection roller 175.

In S806, the control unit 190 determines whether or not the recording paper 201 reaches a tail-end trimming position. When the recording paper 201 has not reached the tail-end trimming position, S805 is repeated. When the recording paper 201 reaches the tail-end trimming position, the flow proceeds to S807.

In S807, the conveyance roller 155 and the paper-ejection roller 175 stop, and the paper-ejection roller 175 fixes the recording paper 201.

In this case, it is also possible for the conveyance roller 155 to stop beforehand as the conveyance roller 155 no longer nips the recording paper 201.

In S808, the second cutter 160 is activated to cut off the margin at the tail end of the recording paper 201.

Next, it is explained operations in a case in which the printer 100 continuously performs printing on plural pieces.

FIG. 6 is a flowchart describing one example of a flow of operations when the printer 100 performs a continuous printing process according to the present embodiment.

FIG. 7 is a diagram describing one example of printable areas on the recording paper 200 according to the present embodiment.

FIG. 8 through FIG. 22 are diagrams describing examples of states of the printer 100 in each step of a process according to the present embodiment.

In S51 in FIG. 6, color printing is performed on a first piece in continuous printing (refer to FIG. 2).

More specifically, the thermal heads 124 and 144 are moved in D direction to be retracted, while the grip roller 115 rotates in F direction to convey the recording paper 200 in A direction (FIG. 8).

When X3 (printing starting point) on the printing paper 200 reaches a printing position P1 of the color recording unit 120, the grip roller 115 stops, and the thermal head 124 moves in D' direction to press against the recording paper 200 (FIG. 9).

The thermal head 124 performs printing while the grip roller 115 rotates in R direction to convey the recording paper 200 in B direction (FIG. 10).

When X2 (printing ending point) on the recording paper 200 reaches the printing position P1 of the color recording unit 120, the grip roller 115 stops, and the thermal head 124 moves in D direction to be retracted.

The above is repeated for each of three primary colors (Y, M and C), and a color image is printed.

In S61 in FIG. 6, the recording paper 200 is cut (refer to FIG. 3).

More specifically, the thermal head 124 is moved in D direction to be retracted, while the grip roller 115 rotates in F direction to convey the recording paper 200 in A direction (FIG. 11).

In the present embodiment, each unit is arranged so that a distance between a cutting position C1 of the first cutter 130 and a nip position R2 of the conveyance roller 155 is the same as a length (Lf+Li+Lb) between X1 and X4 on the recording paper 200.

A fore-end X1 of the recording paper 200 reaches the nip position R2 of the conveyance roller 155, the grip roller 115 stops, and the conveyance roller 155 stops slightly later.

The recording paper 200 is nipped between the grip roller 115 and the conveyance roller 155 to be put under tension. The first cutter 130 is activated and cuts the recording paper 200 at X4 to have a portion whereon color printing has been completed cut off as the recording paper 201 (FIG. 12).

In S71 in FIG. 6, overcoat process is performed on the cut recording paper 201 (refer to FIG. 4).

In the present embodiment, each unit is arranged so that a distance between the nip position of the conveyance roller 155 and a printing position P2 of the overcoat recording unit 140 is the same as a length (Lf) between X1 and X2 on the recording paper 200. Therefore, when the recording paper 200 reaches the cutting position, X2 on the recording paper 201 is positioned at the printing position P2 of the overcoat recording unit 140. Thus, overcoat printing is started without moving the recording paper 201.

The thermal head 144 moves in D' direction and to press against the recording paper 201 before the cutting process in S61 (FIG. 12).

The thermal head 144 performs overcoat printing while the conveyance roller 155 rotates in F direction and conveys the recording paper 201 in A direction (FIG. 13).

When X3 on the recording paper 200 reaches the printing position P2 of the overcoat recording unit 140, the conveyance roller 155 stops, and the thermal head 144 is moved in D direction to be retracted (FIG. 14).

In S81 in FIG. 6, it is performed trimming of the recording paper 201 on which the overcoat process has been completed (refer to FIG. 5).

In the present embodiment, each unit is arranged so that a distance between the cutting position C2 of the second cutter 160 and the printing position P2 of the overcoat recording unit 140 is the same as a length between X7 and X3 on the recording paper 201. Therefore, when the overcoat process is completed, X7 on the recording paper 201 reaches the cutting position C2 of the second cutter 160. Thus, the trimming process is started without moving the recording paper 201.

The second cutter 160 is activated to cut a fore-end margin of the recording paper 201 (FIG. 14).

The conveyance roller 155 rotates in F direction to convey the recording paper 201 in A direction. The paper-ejection roller 175 also rotates in F direction to convey the recording paper 201 passed over from the conveyance roller 155 in A direction (FIG. 15).

When X8 on the recording paper 201 reaches the cutting position C2 of the second cutter 160, the paper-ejection roller 175 stops. The second cutter 160 is activated to cut a tail-end margin of the recording paper 201 (FIG. 16).

Printing on the first piece is completed as stated above. The aforementioned processes have only to be completed before color printing on a second piece is completed. Furthermore, the step for cutting the tail-end margin can be performed after overcoat process on the second piece is started.

The color recording unit 120 performs printing on the second piece in parallel with the overcoat process step and the trimming step for the first piece.

Then, in S92 in FIG. 6, the control unit 190 determines whether or not it is the last one piece to be printed (This includes a case when there is only one piece from the beginning. The case of only one piece from the beginning is described below).

If it is not the last one piece, the flow returns to S52, and next color printing is performed in parallel.

In S52 in FIG. 6, color printing is performed on a second piece (refer to FIG. 2).

In the present embodiment, each unit is arranged so that a distance between the cutting position C1 of the first cutter 130 and the printing position P1 of the color recording unit 120 is the same as a length (Lf+Li) between X4 (X1) and X6 (X3) on the recording paper 200. Therefore, when the recording paper 200 reaches the cutting position, X6 on the recording paper 200 is positioned at the printing position P1 of the color recording unit 120. Thus, color printing process on the second piece is started without moving the recording paper 200.

The thermal head 124 moves in D' direction to press against the recording paper 200 before the cutting process in S61 (FIG. 12).

The thermal head 124 performs color printing while the grip roller 115 rotates in R direction to convey the recording paper 200 in B direction (FIG. 13).

Since the color printing on the second piece is performed in parallel with the overcoat process on the first piece, there is an effect that the printing speed is fast.

Further, since the recording paper 200 is cut by the first cutter 130, the load variation of one thermal head due to its motion, etc. is not conducted to the other thermal head, which allows for high-quality printing.

Further, since contents of the processes are different, the most suitable printing speeds may be different between the color printing and the overcoat printing. The recording paper 200 is cut by the first cutter 130 so that printing speeds of the two processes need not be the same. Therefore, printing under the most suitable conditions is possible, which allows for high-quality printing.

In S92 in FIG. 6, when the control unit 190 determines that it is the last one piece to be printed, the flow proceeds to S72.

Since it is unnecessary to perform the color printing in parallel with the overcoat process for the last one piece, the overcoat process is performed without performing the cutting process.

In S72 in FIG. 6, the overcoat process is performed on the last one piece (refer to FIG. 4). That is, the thermal head 124 is moved in D direction to be retracted, while the grip roller 115 rotates in F direction to convey the recording paper 200 in A direction (FIG. 16).

When the fore-end X1 on the recording paper 200 reaches the nip position R2 of the conveyance roller 155, the grip roller 115 and the conveyance roller 155 stop, and the thermal head 144 moves in D' direction to press against the recording paper 200 (FIG. 17).

The thermal head 144 performs the overcoat printing while the conveyance roller 155 and the grip roller 115 rotate in F direction to convey the recording paper 200 in A direction (FIG. 18).

When X3 on the recording paper 200 reaches the printing position P2 of the overcoat recording unit 140, the conveyance roller 155 stops, and the thermal head 144 is moved in D direction to be retracted (FIG. 18).

In S82 in FIG. 6, trimming is performed on the last one piece (refer to FIG. 5).

As described above, in the present embodiment, the trimming process is started without moving the recording paper 200 when the overcoat process is completed.

The second cutter 160 is activated to cut the fore-end margin of the recording paper 200 (FIG. 19).

The conveyance roller 155 and the grip roller 115 rotate in F direction to convey the recording paper 200 in A direction. The paper-ejection roller 175 also rotates in F direction, and conveys the recording paper 200 passed over from the conveyance roller 155 in A direction (FIG. 20).

When X8 on the recording paper 200 reaches the cutting position C2 of the second cutter 160, the paper-ejection roller 175, the conveyance roller 155 and the grip roller 115 stop. The second cutter 160 is activated to cut a printed portion (recording paper 201) of the recording paper 200 (FIG. 21).

In S93 in FIG. 6, the grip roller 115 and the conveyance roller 155 rotate in R direction to convey the recording paper 200 in B direction and adjust the recording paper 200 to the printing position P1 of the color recording unit 120. Thus, it gets into a state that the next printing can be started immediately and is on standby (FIG. 22). Meanwhile, the paper-ejection roller 175 rotates in F direction to convey the recording paper 201 in A direction and eject the recording paper 201 (FIG. 22).

As shown above, in the printing on the last one piece, the overcoat process and the trimming process are directly performed without performing the cutting step, so that there is an effect that the printing speed becomes faster.

Further, the portion to be cut off as a tail-end margin is not detached from the recording paper 200. Therefore, the portion can be used in the next printing (as a fore-end margin), and it is made possible to use resources effectively.

Next, it is explained operations in the printer 100 in a case of performing printing on only one piece.

FIG. 23 is a flowchart describing one example of a flow of operations when the printer 100 performs printing on one piece according to the present embodiment.

In S51 in FIG. 23, the color printing is performed (refer to FIG. 2).

That is, the thermal heads 124 and 144 are moved in D direction to be retracted, while the grip roller 115 rotates in F direction to convey the recording paper 200 in A direction (FIG. 8).

When X3 on the recording paper 200 reaches the printing position P1 of the color recording unit 120, the grip roller 115 stops, and the thermal head 124 moves in D' direction to press against the recording paper 200 (FIG. 9).

The thermal head 124 performs printing while the grip roller 115 rotates in R direction to convey the recording paper 200 in B direction (FIG. 10).

When X2 on the recording paper 200 reaches the printing position P1 of the color recording unit 120, the grip roller 115 stops, and the thermal head 124 is moved in D direction to be retracted.

The above is repeated for each of three primary colors (Y, M and C), and a color image is printed.

In S72 in FIG. 23, the overcoat process is performed (refer to FIG. 4).

That is, the thermal head 124 is moved in D direction to be retracted, and the grip roller 115 rotates in F direction to convey the recording paper 200 in A direction (FIG. 16).

When the fore-end X1 on the recording paper 200 reaches the nip position R2 of the conveyance roller 155, the grip roller 115 and the conveyance roller 155 stop, and the thermal head 114 moves in D' direction to press against the recording paper 200 (FIG. 17).

The thermal head 144 performs the overcoat printing while the conveyance roller 155 and the grip roller 115 rotate in F direction to convey the recording paper 200 in A direction (FIG. 18).

When X3 on the recording paper 200 reaches the printing position P2 of the overcoat recording unit 140, the conveyance roller 155 stops, and the thermal head 144 is moved in D direction to be retracted (FIG. 18).

In S82 in FIG. 23, the trimming process is performed (refer to FIG. 5).

As described above, in the present embodiment, the trimming process is started without moving the recording paper 200 when the overcoat process is completed.

The second cutter 160 is activated to cut off the fore-end margin of the recording paper 200 (FIG. 19).

The conveyance roller 155 and the grip roller 115 rotate in F direction to convey the recording paper 200 in A direction. The paper-ejection roller 175 also rotates in F direction, and conveys the recording paper 200 passed over from the conveyance roller 155 in A direction (FIG. 20).

When X8 on the recording paper 200 reaches the cutting position C2 of the second cutter 160, the paper-ejection roller 175, the conveyance roller 155 and the grip roller 115 stop. The second cutter 160 is activated to cut off the printed portion (recording paper 201) of the recording paper 200 (FIG. 21).

In S93 in FIG. 23, the grip roller 115 and the conveyance roller 155 rotate in R direction to convey the recording paper 200 in B direction, and prepare for the next printing (FIG. 22). Further, the paper-ejection roller 175 rotates in F direction, and conveys the recording paper 201 in A direction to eject the recording paper 201 (FIG. 22).

Thus, even in a case of performing printing only on one piece, the cutting step is not performed, so that there is an effect that the printing speed becomes faster.

In the present embodiment as shown above, when the number of pieces to be printed is only one, the printing time can be reduced in comparison with a case of activating the first cutter 130 by not performing the cutting operation of the recording paper 200 by the first cutter 130.

The details of the operations in the printer 100 according to the present embodiment are not limited to what described above, which may be realized by other methods.

FIG. 24 is a diagram describing another example of a structure of main parts of the printer 100 (one example of the printing device) according to the present embodiment.

The printer 100 in FIG. 24 is almost the same as what described using FIG. 1, but is different in that it has a reflective sensor 180.

In this example, to adjust the position of the recording paper 200, marks describing a recording starting point, a cutting point, etc. of the recording paper 200 are printed on the reverse side of the recording paper 200 beforehand. The reflective sensor 180 detects these marks to adjust the position of the recording paper 200.

The marks can be printed on the adverse side of the recording paper. It may be possible to have the marks printed by the color recording unit 120 at the time of performing the first printing, not printed beforehand.

Further, it may be possible to install a transmissive sensor instead of the reflective sensor 180.

Further, the reflective sensor 180 can be installed at another position on a conveyance path of the recording paper 200.

In the example as described above, each unit is suitably arranged so that the recording papers 200 and 201 need not be conveyed after preceding steps are completed and at the time of proceeding to next steps.

More specifically, a distance between the printing position P1 (nip position of the platen roller 125) of the color recording unit 120 and the cutting position C1 of the first cutter 130 in FIG. 1 is the same as the length (=Lf+Li) between X1 and X3 on the recording paper 200 in FIG. 7.

Further, a distance between the cutting position C1 of the first cutter 130 and the printing position P2 (nip position of the platen roller 145) of the overcoat recording unit 140 in FIG. 1 is the same as a length (=Li+Lb) between X2 and X4 on the recording paper 200 in FIG. 7.

Further, a distance between the printing position P2 of the overcoat recording unit 140 and the nip position R2 of the conveyance roller 155 in FIG. 1 is the same as the length (=Lf) between X1 and X2 on the recording paper 200 in FIG. 7.

Further, a distance between the printing position P2 of the overcoat recording unit 140 and the cutting position C2 of the second cutter 160 in FIG. 1 is the same as a length between X7 and X3 on the recording paper 200 in FIG. 7.

Thus, since the time taken for paper feeding operation for conveying the recording paper 200 can be shortened, there is an effect that the printing speed as a whole becomes faster.

However, in some cases, an ideal arrangement as mentioned above is impossible due to restrictions such as a size of each unit.

In such a case, the distance between P1 and C1 can be longer than the length between X1 and X3.

Further, the distance between C1 and P2 can be longer than the length between X2 and X4.

Further, the distance between C1 and R2 can be shorter than the length between X1 and X4.

Further, the distance between P2 and C2 can be longer or shorter than the length between X7 and X3.

With the configuration as mentioned above, the printing speed becomes slower, but each unit can be arranged in a more flexible manner. Therefore, there is an effect such as reduction of production costs and miniaturization of the device as a whole.

The length (=Lb) between X3 and X4 in FIG. 7 can be zero. This eliminates the need for cutting the tail-end margin in the trimming step to makes it possible to reduce the process and quicken the printing speed. Further, it is preferable since resources can be utilized effectively and the waste can be reduced.

However, the length can be about a few millimeters in consideration of a margin for cutting by the first cutter 130.

Further, X7 can be at the same position as X2. It is also possible to have X8 positioned at the same position as X3 or X4.

As described above, by establishing the color recording unit 120 for performing the color recording and the overcoat recording unit 140 for performing the overcoat recording separately, and by cutting the recording paper 200 by the first cutter 130 provided between the color recording unit 120 and the overcoat recording unit 140 after color recording ends, it is possible to perform the color recording on a second piece at the color recording unit 120, and the overcoat process on a color-recorded image on the first piece at the overcoat recording unit simultaneously without being affected by load variations in each of the recording units. Therefore, a printing time for the second or later piece can be shortened without deteriorating printing quality due to the load variations.

Further, it is so configured that the color recording unit 120 for performing the color recording and the overcoat recording unit 140 for performing the overcoat recording are installed separately, and the recording paper 200 is conveyed in the recording-paper returning direction (B direction) at the color recording unit 120, and the cut recording paper 201 is conveyed in the paper-ejection direction (A direction) at the overcoat recording unit 140. Thus, even when different conveyance speeds are set in each recording unit, the recording papers 200 and 201 do not interfere with each other in the conveyance path, and it is possible to have the color recording unit 120 for performing the color recording and the overcoat recording unit 140 for performing the overcoat recording carry out processes in an asynchronous and independent manner. Therefore, it becomes possible to set the most suitable recording condition for each recording unit.

Further, by setting the distance from the color recording starting position (printing position) P1, which is the nip position between the thermal head 124 and the platen roller 125, to the cutting position C1 of the recording paper 200 by the first cutter 130 the same length as the sum of the length of the recording image plane Li and the length of the fore-end margin of the recording image plane Lf, and by setting the distance from the first cutter 130 to the overcoat recording starting position (printing position) P2, which is the nip position between the thermal head 144 and the platen roller 145, the same as the sum of the length of the recording image plane Li and the length of the tail-end of the recording image plane Lb, it is possible to perform the color recording operation on a second piece and the overcoat recording operation on a first piece immediately after the cutting operation of the recording paper 200 is completed by the first cutter 130 without the need of an unnecessary conveyance operation of recording papers. Therefore, it is possible to perform effective printing operations and reduce the printing time.

In the present embodiment, the position of the recording paper 200 is adjusted by managing (counting) the conveyance amount of the grip roller 115. However, as shown in FIG. 24, it may be also possible to adjust the position of the recording paper 200 by applying marks indicating a recording starting point and a recording paper cutting point on the reverse side of the recording paper 200, and by installing the reflective sensor 180 for detecting these marks in the conveyance path of the recording paper 200. These are the same in the following embodiments as well.

The printing device (printer 100) according to the present embodiment includes:

the first printing unit (color recording unit 120) to perform printing on the printing medium (recording paper 200);

the cutting unit (first cutter 130) to cut the portion (recording paper 201) on which the printing is performed by the first printing unit (color recording unit 120) from the printing medium (recording paper 200); and the second printing unit (overcoat recording unit 140) to perform printing on the printing medium strip (recording paper 201) cut by the cutting unit (the first cutter 130).

The first printing unit (color recording unit 120) performs the printing on the printing medium (recording paper 200) in parallel with the printing on the printing medium strip (recording paper 201) performed by the second printing unit (overcoat recording unit 140).

The printing device (printer 100) further includes:

the main body of the printing device;

the first rotation unit (grip roller 115) to nip the printing medium (recording paper 200) between the rollers rotatably fixed to the main body of the printing device, and to convey the printing medium (recording paper 200) by rotating the rollers; and the second rotation unit (conveyance roller 155) to nip the printing medium (recording paper 200) and the printing medium strip (recording paper 201) between the rollers rotatably fixed to the main body of the printing device, and to convey the printing medium (recording paper 200) and the printing medium strip (recording paper 201) by rotating the rollers, wherein the first printing unit (color recording paper 120) performs the printing on the printing medium (recording paper 200) at the prescribed position (P1) between the first nip position (R1) at which the first rotation unit (grip roller 115) nips the printing medium (recording paper 200) and the second nip position (R2) at which the second rotation unit (conveyance roller 155) nips the printing medium (recording paper 200) and the printing medium strip (recording paper 201), wherein the cutting unit (first cutter 130) cuts the printing medium (recording paper 200) at the prescribed position (C1) between the first printing position (P1) at which the first printing unit (color recording unit 120) performs the printing on the printing medium (recording paper 200) and the second nip position (R2), and wherein the second printing unit (overcoat recording unit 140) performs the printing on the printing medium strip (recording paper 201) at the prescribed position (P2) between the cutting position (C1) at which the cutting unit (first cutter 130) cuts the printing medium (recording paper 200) and the second nip position (R2).

The first rotation unit (grip roller 115) conveys the printing medium (recording paper 200) to the prescribed printing starting position by rotating the rollers in the prescribed direction (F direction), conveys the printing medium (recording paper 200) in a prescribed printing ending position by rotating the rollers in the direction (R direction) against the prescribed direction after the first printing unit (color recording unit 120) starts printing on the printing medium (recording paper 200), conveys the printing medium (recording paper 200) to the prescribed cutting position by rotating the rollers in the prescribed direction (F direction) after the first printing unit (color recording unit 120) completes the printing on the printing medium (recording paper 200), and conveys the printing medium (recording paper 200) to the prescribed printing ending position by rotating the rollers in the direction (R direction) against the prescribed direction after the cutting unit (first cutter 130) cuts the printing medium (recording paper 200) and the first printing unit (color printing unit 120) starts the next printing on the printing medium (recording paper 200).

The first rotation unit (grip roller 115) further conveys the printing medium (recording paper 200) to the prescribed cutting position by rotating the rollers in the prescribed direction (F direction) after the first printing unit (color recording unit 120) performs the last printing on the printing medium (recording paper 200), and conveys the printing medium (recording paper 200) to the prescribed printing ending position by rotating the rollers in the prescribed direction after the second printing unit (overcoat recording unit 140) starts printing on the printing medium (recording paper 200).

The second rotation unit (conveyance roller 155) nips the printing medium (recording paper 200) conveyed by the first rotation unit (grip roller 115) between the rollers, conveys the printing medium (recording paper 200) to the prescribed cutting position by rotating the rollers in the prescribed direction (F direction), and conveys the printing medium strip (recording paper 201) to the prescribed printing ending position by rotating the rollers in the prescribed direction (F direction) after the cutting unit (first cutter 130) cuts the printing medium (recording paper 200) and the second printing unit (overcoat recording unit 140) starts printing on the printing medium strip (recording paper 201).

Embodiment 2

The second embodiment is explained using FIG. 25 through FIG. 28.

FIG. 25 is a diagram describing one example of a structure of main parts of the printer 100 (one example of the printing device) according to the present embodiment.

In FIG. 25, the printer 100 includes the grip roller 115 (one example of the first rotation unit), the color recording unit 120 (one example of the first printing unit), a conveyance roller 116 (third rotation unit), the first cutter 130 (one example of the cutting unit), a conveyance roller 156 (fourth rotation unit), the overcoat recording unit 140 (one example of the second printing unit), the conveyance roller 155 (one example of the second rotation unit), the second cutter 160 (one example of the margin cutting unit), the paper-ejection roller 175, and the control unit 190.

Among the above, the grip roller 115, the color recording unit 120, the first cutter 130, the overcoat recording unit 140, the conveyance roller 155, the second cutter 160 and the paper-ejection roller 175 are the same as those described in the first embodiment using FIG. 1. Therefore, the explanations are omitted here.

The conveyance rollers 116 and 156 each include two rollers, which are a lower roller fixed to the main body of the printer 100 in a manner rotatable in F-R direction, and an upper roller corresponding to the lower roller and rotatably fixed to the main body of the printer 100. Each of the lower rollers is connected to an unshown stepping motor, and is rotated by a drive force of the stepping motor. The lower rollers rotate for arbitrary rotational angles by control of the control unit 190 over the stepping motors. Further, it is possible to stop their rotations and fix the lower rollers by keeping the stepping motors in an excitation state. The upper rollers can be freely rotated, and are rotated corresponding to the rotations of the lower rollers.

The conveyance rollers 116 and 156 nip the recording paper 200 by holding the recording paper 200 at nip positions R3 and R4 between the upper rollers and the lower rollers. By rotating the conveyance rollers 116 and 156 in F direction, the nipped recording paper 200 can be conveyed in A direction. By rotating the conveyance rollers 116 and 156 in R direction, the nipped recording paper 200 can be conveyed in B direction. Further, by stopping the rotations, it is possible to immovably fix the recording paper 200.

The conveyance rollers 116 and 156 are arranged just ahead and behind the first cutter 130.

Next, detailed explanations of operations during printing are presented.

The operations of the printer 100 are based on four steps of the color printing step, the cutting step, the overcoat process step, and the trimming step.

FIG. 26 is a flowchart describing one example of a flow of operations of the printer 100 in the cutting step according to the present embodiment.

In S621, the grip roller 115 and the conveyance rollers 116 and 156 rotate in F direction to convey the recording paper 200 in A direction.

At this time, the conveyance roller 155 also rotates in F direction simultaneously. This allows the conveyance roller 155 to nip the recording paper 200 when the fore-end of the recording paper 200 reaches the conveyance roller 155.

In this case, circumferential speeds (rotation speeds) of the conveyance rollers 116 and 156 are set approximately the same as the circumferential speed of the grip roller 115.

In S622, the control unit 190 determines whether or not the recording paper 200 reaches the cutting position. When the recording paper 200 has not reached the cutting position, S621 is repeated. When the recording paper 200 reaches the cutting position, the flow proceeds to S623.

In S623, the grip roller 115 and the conveyance rollers 116, 156 and 155 stop to fix the recording paper 200.

In S624, the first cutter 130 is activated to cut the recording paper 200.

At this time, the recording paper 200 is secured by the conveyance rollers 116 and 156 at the positions just ahead and just behind the cutting position C1. By keeping the stepping motors for driving the conveyance rollers 116 and 156 in an excitation (HOLD) state, the conveyance rollers 116 or 156 are not moved by the load of the cutting operation and are put under restraint.

In the example of the structure described in the first embodiment, it is necessary to lengthen the distance between R1 and C1, and C1 and R2 to broaden the printable areas. In the example, the distance between R1 and R2 is set long, so that there is a possibility that the recording paper 200 shifts at the time of cutting, and cutting cannot be performed precisely.

In the present embodiment, the conveyance rollers 116 and 156 positioned at a relatively short distance nip the recording paper 200, and the first cutter 130 cuts the recording paper 200 so that there is an effect that the recording paper 200 does not slip in A-B direction, and a stable cutting operation can be performed accurately.

Also in the color printing step, the overcoat process step and the trimming step, the conveyance rollers 116 and 156 operate in combination with the other rollers so that the recording paper 200 can be conveyed more accurately.

The conveyance roller 116 conveys the recording paper 200 at the same speed as the grip roller 115. Further, the conveyance roller 156 conveys the recording papers 200 and 201 at the same speed as the conveyance roller 155 and the paper-ejection roller 175.

Therefore, the stepping motor for driving the conveyance roller 116 can be used also as the stepping motor for driving the grip roller 115.

Similarly, the stepping motor for driving the conveyance roller 156 can be used also as the stepping motor for driving the conveyance roller 155 and the paper-ejection roller 175.

Then, it is not necessary to add stepping motors even when a conveyance roller is added, so that the production cost of the printer 100 can be reduced.

Further, by installing the conveyance rollers 116 and 156, limitations on deployment of each unit are eased.

More specifically, in the example of the structure described in the first embodiment, the distance between C1 and R2 cannot be longer the length between X1 and X4. This is because if the fore-end of the recording paper 200 is cut off before the fore-end reaches the nip position R2 of the conveyance roller 155, the cut recording paper 201 cannot be conveyed.

According to the present embodiment, the conveyance roller 156 is included, so that when the distance between C1 and R4 and the distance between R4 and R2 are shorter than the distance between X1 and X4, the recording paper 201 can be conveyed by having the recording paper 201 being nipped by the conveyance roller 156 at time of cutting, being conveyed by the conveyance roller 156 at the time of overcoat process, and being transferred to the conveyance roller 155 during the overcoat process step.

FIG. 27 is a flowchart describing another example of a flow of operations of the printer 100 in the cutting step according to the present embodiment.

FIG. 28 is a diagram describing one example of a state of the printer 100 in the cutting step according to the present embodiment.

In S641, the grip roller 115 and the conveyance rollers 116 and 156 rotate in F direction to convey the recording paper 200 in A direction.

At this time, the conveyance roller 155 also rotates in F direction simultaneously. This allows the conveyance roller 155 to nip the recording paper 200 when the fore-end of the recording paper 200 reaches the conveyance roller 155.

In S642, the control unit 190 determines whether or not the recording paper 200 reaches the cutting position. When the recording paper 200 has not reached the cutting position, S641 is repeated. When the recording paper 200 reaches the cutting position, the flow proceeds to S643.

In S643, the grip roller 115 and the conveyance rollers 116, 156 and 155 stop to fix the recording paper 200.

In S644, the conveyance roller 116 rotates in R direction, and the conveyance roller 156 rotates in F direction. The conveyance rollers 116 and 156 pull the recording paper 200 at approximately the same power, so that the recording paper 200 is not conveyed and rests under tension.

At this time, it is configured that the friction between the conveyance roller 116 or 156 and the recording paper 200 is small, so that the conveyance rollers 116 and 156 slip and spin free.

In S645, the first cutter 130 is activated to cut the recording paper 200.

As shown above, by configuring the conveyance rollers 116 and 156 to pull the recording paper 200 from the left and right sides as well as to fix the recording paper 200 at the time of cutting, the recording paper 200 is cut under tension. Therefore, cutting error does not occur due to a slack in the recording paper 200, and the cutting paper 200 can be cut clearly and accurately.

At this time, to prevent the recording paper 200 from being broken, a mechanism for restricting the power to be applied to the recording paper 200 becomes necessary. It may be possible to have a structure for weakening the friction force as shown above. In this case, a slip is occurred between the recording paper 200 and the conveyance roller 116 or 156.

Alternatively, it may be possible to have a structure that a torque limiter is installed in a drive force transmission mechanism between the conveyance roller 116 or 156 and the unshown stepping motors, so that a drive force more than a prescribed value is not applied to the conveyance roller 116 or 156. This makes the conveyance rollers 116 and 156 succumb to the friction forces with the recording paper 200 and stop rotating.

In this case, the conveyance forces and the circumferential speeds of the recording paper in the conveyance rollers 116 and 156 are set approximately the same. This allows the conveyance forces of the conveyance rollers 116 and 156 to be in well balance. In the conveyance rollers 116 and 156, a torque larger than a set value in the torque limiter occurs, and the torque limiter spins free. Therefore, both the conveyance rollers 116 and 156 stop. By configuring in this manner, a slip does not occur between the recording paper 200 and the conveyance roller 116 or 156, and the recording paper 200 gets under tension at the cutting position C1.

By configuring in this manner, there is a possibility that conveyance by the conveyance rollers 116 and 156 is not always accurate. However, the conveyance rollers 116 and 156 are only supplemental, and in the color recording unit 120 wherein accurate conveyance is required, the grip roller 115 handles conveyance of the recording paper 200, so that the printing quality is not deteriorated.

The printing device (printer 100) according to the present embodiment, further includes:

the third rotation unit (conveyance roller 116) to nip the printing medium (recording paper 200) between the rollers rotatably fixed to the main body of the printing device between the first printing position (P1) and the cutting position (C1), and to convey the printing medium (recording paper 200) by rotating the rollers; and the fourth rotation unit (conveyance roller 156) to nip the printing medium (recording paper 200) and the printing medium strip (recording paper 201) between the rollers rotatably fixed to the main body of the printing device between the second printing position (P2) at which the second printing unit (overcoat recording unit 140) performs the printing on the printing medium strip (recording paper 201) and the cutting position (C1), and to convey the printing medium (recording paper 200) and the printing medium strip (recording paper 201) by rotating the rollers.

The third rotation unit (conveyance roller 116) nips the printing medium (recording paper 200) conveyed by the first rotation unit (grip roller 115) between the rollers, conveys the printing medium (recording paper 200) to the prescribed cutting position by rotating the rollers in the prescribed direction (F direction), and fixes the printing medium (recording paper 200) at the prescribed cutting position by stopping the rollers, the fourth rotation unit (conveyance roller 156) nips the printing medium (recording paper 200) conveyed by the third rotation unit (conveyance roller 116) between the rollers, conveys the printing medium (recording paper 200) to the prescribed cutting position by rotating the rollers in the prescribed direction (F direction), and fixes the printing medium (recording paper 200) at the prescribed cutting position by stopping the rollers, and the cutting unit (first cutter 130) cuts the printing medium (recording paper 200) fixed by the third rotation unit (conveyance roller 116) and the fourth rotation unit (conveyance roller 156).

The third rotation unit (conveyance roller 116) nips the printing medium (recording paper 200) conveyed by the first rotation unit (grip roller 115) between the rollers, conveys the printing medium (recording paper 200) to the prescribed cutting position by rotating the rollers in the prescribed direction (F direction), and pulls the printing medium (recording paper 200) at a prescribed force by rotating the rollers in the direction (R direction) against the prescribed direction, the fourth rotation unit (conveyance roller 156) nips the printing medium (recording paper 200) conveyed by the third rotation unit (conveyance roller 116) between the rollers, conveys the printing medium (recording paper 200) to the prescribed cutting position by rotating the rollers in the prescribed direction (F direction), and fixes the printing medium (recording paper 200) at the prescribed cutting position by pulling the printing medium (recording paper 200) at a force in balance with the prescribed force applied to the printing medium (recording paper 200) by the third rotation unit (conveyance roller 116) by rotating the rollers in the prescribed direction (F direction), and the cutting unit (first cutter 130) cuts the printing medium (recording paper 200) fixed in a state being pulled from the both sides by the third rotation unit (conveyance roller 116) and the fourth rotation unit (conveyance roller 156).

Embodiment 3

The third embodiment is described using FIG. 29 through FIG. 32.

FIG. 29 is a diagram describing one example of a structure of main parts of the printer 100 (one example of the printing device) according to the present embodiment.

In FIG. 29, the printer 100 includes the grip roller 115 (one example of the first rotation unit), the color recording unit 120 (one example of the first printing unit), the first cutter 130 (one example of the cutting unit), the overcoat recording unit 140 (one example of the second printing unit), the second cutter 160 (the margin cutting unit), the paper-ejection roller 175 and the control unit 190.

Among the above, the grip roller 115, the color recording unit 120, the first cutter 130, the second cutter 160 and the paper-ejection roller 175 are the same as those explained in the first embodiment using FIG. 1. Therefore, the explanations are omitted here.

The overcoat recording unit 140 includes the supply reel 141, the take-up reel 142, the thermal head 144, and the platen roller 145 (one example of the second rotation unit), and performs the overcoat process (printing) on the recording paper 200 at the printing position P2.

Among the above, the supply reel 141, the take-up reel 142 and the thermal head 144 are the same as those explained in the first embodiment using FIG. 1. Therefore, the explanations are omitted here.

The platen roller 145 is fixed to the main body of the printer 100 in a manner rotatable in F-R direction. The platen roller 145 holds the recording paper 200 from the reverse side when the thermal head 144 presses against the recording paper 200, which allows for a stable printing.

The platen roller 145 is connected to an unshown stepping motor, and is rotated by a drive force of the stepping motor. The platen roller rotates for an arbitrary rotational angle by control of the control unit 190 over the stepping motor. Further, it is possible to stop the rotation and fix the platen roller by keeping the stepping motor in an excitation state.

The platen roller 145 nips the recording paper 200 with the thermal head 144 while the thermal head 144 moves in D' direction and is kept pressing against the recording papers 200 and 201. By rotating the platen roller 145 in F direction, the nipped recording paper 200 can be conveyed in A direction. By rotating the platen roller 145 in R direction, the nipped recording paper 200 can be conveyed in B direction. Further, it is possible to immovably fix the recording paper 200 by stopping the rotation.

Thus, the platen roller 145 according to the present embodiment also has the function of the conveyance roller 155 (the second rotation unit) described in the first embodiment.

Next, detailed explanations of operations at the time of printing are presented.

The operations of the printer 100 are based on four steps of the color printing step, the cutting step, the overcoat process step, and the trimming step.

FIG. 30 is a flowchart describing one example of a flow of operations of the printer 100 in the cutting step according to the present embodiment.

FIG. 31 and FIG. 32 are diagrams describing examples of states of the printer 100 in the cutting step according to the present embodiment.

In S661, the grip roller 115 rotates in F direction to convey the recording paper 200 in A direction (FIG. 31).

In S662, the control unit 190 determines whether or not the recording paper 200 reaches the cutting position. When the recording paper 200 has not reached the cutting position, S661 is repeated. When the recording paper 200 reaches the cutting position, the flow proceeds to S663.

In S 663, the grip roller 115 and the platen roller 145 stop. The grip roller 115 nips and fixes the recording paper 200 (FIG. 32).

In S664, the thermal head 144 moves in D' direction to press against the recording paper 200. The thermal head 144 and the platen roller 145 nip and fix the recording paper 200 (FIG. 32).

Alternatively, it may possible to have the thermal head 144 move in D' direction to press against the recording paper 200 before the grip roller 115 and the platen roller 145 stop.

Further, it may be possible to have the thermal head 124 move in D' direction to press against the recording paper 200 after the grip roller 115 and the platen roller 145 stop.

In S665, the first cutter 130 is activated to cut the recording paper 200 (FIG. 32).

Then, the overcoat process step is performed on the cut recording paper 201, and the color printing step is performed on the recording paper 200.

In the first embodiment, the distance between the printing position P2 of the overcoat recording unit 140 and the nip position R2 of the conveyance roller 155 is quite large. The distance between P2 and R2 cannot be shorter than the length between X1 and X2 on the recording paper 200 in FIG. 7, so that the smaller the distance between P2 and R2 is, the shorter the fore-end margin becomes.

As shown above, by allowing the platen roller 145 to have the function as the second rotation unit as well, it is possible to co-locate the printing position P2 of the overcoat recording unit 140 and the nip position R2 of the platen roller 145. That is to say, there is an effect to reduce the size of the fore-end margin (between X1 and X2, which is equal to Lf).

In the trimming step, the smaller the size of the fore-end margin of the recording paper 200 to be cut becomes, the less redundant portions of the recording paper 200 become. This leads to an effective use of resources and a reduction in wastes, which is preferable. Further, if it is unnecessary to cut the fore-end margin, the cutting step of fore-end margin can be omitted from the trimming step, so that the printing speed as a whole is improved.

By configuring the platen roller 145 to convey the recording papers 200 and 201, the conveyance accuracy is reduced in comparison with a case of conveyance by the conveyance roller 155.

However, the overcoat process step does not need so high accuracy in conveyance as the color printing step. This is because, in the color printing step, color registration errors etc. largely affect quality of printing result, so that a high-accuracy conveyance is necessary; whereas in the overcoat process step, even though conveyance is not performed with so high accuracy, it does not affect the quality of printing results.

Therefore, the printing quality is not deteriorated even with the configuration as in the present embodiment.

The printing device (printer 100) according to the present embodiment, further includes:

the main body of the printing device; and the first rotation unit (grip roller 115) to nip the printing medium (recording paper 200) between the rollers rotatably fixed to the main body of the printing device, and to convey the printing medium (recording paper 200) by rotating the rollers, wherein the first printing unit (color recording unit 120) performs the printing on the printing medium (recording paper 200) at the prescribed position (P1) between the first nip position (R1) at which the first rotation unit (grip roller 115) nips the printing medium (recording paper 200) and the second printing position (P2) at which the second printing unit (overcoat recording unit 140) performs the printing on the printing medium strip (recording paper 201), wherein the cutting unit (the first cutter 130) cuts the printing medium (recording paper 200) at the prescribed position (C1) between the first printing position (P1) at which the first printing unit (color recording unit 120) performs the printing on the printing medium (recording paper 200) and the second printing position (P2), and wherein the second printing unit (overcoat recording unit 140) further nips the printing medium (recording paper 200) and the printing medium strip (recording paper 201) between the printing head (thermal head 144) and the platen roller 145 rotatably fixed to the main body of the printing device, and conveys the printing medium (recording paper 200) and the printing medium strip (recording paper 201) by rotating the platen roller 145.

The second printing unit (overcoat recording unit 140) nips the printing medium (recording paper 200) conveyed to the prescribed cutting position by the first rotation unit (grip roller 115) between the printing head (thermal head 144) and the platen roller 145, and after the cutting unit (the first cutter 130) cuts the printing medium (recording paper 200), performs printing on the printing medium strip (recording paper 201) while conveying the printing medium strip (recording paper 201) to the prescribed printing ending position by rotating the platen roller 145.

Embodiment 4

The fourth embodiment is described using FIG. 33 through FIG. 39.

FIG. 33 is a diagram describing one example of a structure of main parts of the printer 100 (one example of the printing device) according to the present embodiment.

In FIG. 33, the printer 100 includes the grip roller 115 (one example of the first rotation unit), the color recording unit 120 (one example of the first printing unit), the conveyance roller 116, the first cutter 130 (one example of the cutting unit), the conveyance roller 156, the overcoat recording unit 140 (one example of the second printing unit), the second cutter 160 (one example of the margin cutting unit), the paper-ejection roller 175, and the control unit 190.

Among the above, the grip roller 115, the color recording unit 120, the conveyance roller 116, the first cutter 130, the conveyance roller 156, the second cutter 160 and the paper-ejection roller 175 are the same as those described in the second embodiment. Therefore, the explanations are omitted here. Additionally, since the overcoat recording unit 140 is the same as what explained in the third embodiment, the explanation thereof is omitted here.

As stated below, in the present embodiment, a sufficient space is secured between the printing position P1 of the color recording unit 120 and the nip position R3 of the conveyance roller 116 to keep a slack in the recording paper. Similarly, a sufficient space is secured between the nip position R4 of the conveyance roller 156 and the printing position P2 of the overcoat recording unit 140.

Next, detailed explanations of operations at the time of printing are presented.

The operations of the printer 100 are based on four steps of the color printing step, the cutting step, the overcoat process step, and the trimming step.

FIG. 34 is a flowchart describing one example of a flow of operations of the printer 100 in the cutting step according to the present embodiment.

FIG. 35 through FIG. 38 are diagrams describing examples of states of the printer 100 in the cutting step according to the present embodiment.

In S681 in FIG. 34, the grip roller 115 and the conveyance rollers 116 and 156 rotate in F direction to convey the recording paper 200 in A direction (FIG. 35). At this time, the conveyance rollers 116 and 156 are rotary driven at a circumferential speed approximately the same as that of the grip roller 115.

In S682 in FIG. 34, the control unit 190 determines whether or not the recording paper 200 reaches the nip position R2 of the platen roller 145. When the recording paper 200 has not reached the nip position R2, S681 is repeated. When the recording paper 200 reaches the nip position R2, the flow proceeds to S683.

In S683 in FIG. 34, the grip roller 115, the conveyance rollers 116 and 156, and the platen roller 145 stop to fix the recording paper 200 at the nip positions R1, R3 and R4.

In S684 in FIG. 34, the thermal head 144 moves in D' direction to press against the recording paper 200. The thermal head 144 and the platen roller 145 nip and fix the recording paper 200 (FIG. 36).

In S685 in FIG. 34, the grip roller 115 and the conveyance rollers 116 and 156 rotate in F direction to convey the recording paper 200 in A direction (FIG. 36).

At this time, the fore-end of the recording paper 200 is nipped and fixed by the thermal head 144 and the platen roller 145 at the nip position R2, so that a slack is generated in the recording paper 200 between the nip position R4 of the conveyance roller 156 and the nip position R2 of the platen roller (FIG. 36).

In S686 in FIG. 34, the control unit 190 determines whether or not the recording paper 200 reaches the cutting position. When the recording paper 200 has not reached the cutting position, S685 is repeated. When the recording paper 200 reaches the cutting position, the flow proceeds to S687.

In S687 in FIG. 34, the conveyance rollers 116 and 156 stop to fix the recording paper 200 at the nip positions R3 and R4. On the other hand, the grip roller 115 remains to continue rotating in F direction, and conveys the recording paper 200 in A direction. The space wherein a slack is generated in the recording paper 200 is provided between the printing position P1 of the color recording unit 120 and the nip position R3 of the conveyance roller 116. Accordingly, a slack is generated in the recording paper 200 between P1 and R3 (FIG. 37).

In S688 in FIG. 34, the first cutter 130 is activated to cut the recording paper 200 (FIG. 37).

In this case, in S683 through S685, it may be possible to have the thermal head 144 press against the recording paper 200 while having the grip roller 115 and the conveyance rollers 116 and 156 continue rotating without stopping.

Alternatively, it may be possible to reverse the order of S684 and S683, and to have the platen roller 145 stop its rotation after the thermal head 144 presses to come into contact with the recording paper 200.

As shown above, by having each roller rotate and stop at different timings, a slack is generated in the recording paper 200 between the nip positions, and each unit can be arranged in a more flexible manner.

That is, it is possible to set the length between X1 and X3 on the recording paper 200 longer than the distance between P1 and C1.

Further, it is possible to set the length between X2 and X4 on the recording paper 200 longer than the distance between C1 and P2.

Therefore, there is an effect that even when the printing areas are long, it is unnecessary to increase the size of the printer 100 and miniaturization is possible.

Further, it is possible to start the overcoat process step without waiting for the cutting step to end.

That is to say, in S684 in FIG. 34, the overcoat process step can be started at the time the thermal head 144 presses against the recording paper 200 and in S685, the conveyance rollers 116 and 156 restart conveyance of the recording paper 200 (FIG. 37 and FIG. 38).

At this time, the speed the platen roller 145 conveys the recording paper 200 needs not coincide with the conveyance speeds of the conveyance rollers 116 and 156, and can be slower than the conveyance speeds of the conveyance rollers 116 and 156. In this case, the recording paper 200 slackens between R4 and P2 so that differences of the conveyance speeds are absorbed.

In this case, it may be also possible to start the overcoat process without stopping the platen roller 145 in S683.

Further, when the conveyance speed of the platen roller 145 is faster instead, it is only necessary to start the overcoat process step after a sufficient slack is generated between R4 and P2.

Therefore, there are effects that it is possible to convey the recording paper 200 in an appropriate speed for the overcoat process, and perform high-quality printing.

The color printing step is started after X6 on the recording paper 200 reaches the printing position P1 of the color recording unit 120. The cutting operation in S688 can be performed after the recording paper 200 reaches the color printing position. Otherwise, the cutting operation can be performed without waiting for the recording paper 200 to reach the color printing position.

Further, it may be possible to generate the slack on the side of the color recording unit 120 between R3 and C1, not between P1 and R3.

For example, as in FIG. 39, the blades are kept closed as they are after the first cutter 130 cuts the recording paper 200, and the conveyance roller 116 is rotated in F direction to convey the recording paper 200 in A direction. The recording paper 200 comes into contact with the blades of the first cutter 130 to cause the fore-end of the recording paper 200 to sag.

In this case, during the cutting operation in S688, the conveyance roller 116 needs to be stopped. It may be also possible to have the grip roller 115 stopped during the cutting operation. Otherwise, it may be also possible to absorb the slack generated between P1 and R3 during the cutting operation by having the grip roller 115 keep rotating as it is, and the conveyance roller 116 rotate slightly faster than the grip roller 115 after restarting conveyance.

This allows for high-quality printing since the printing position does not go out of line due to an influence of the slack in the recording paper 200.

Further, in the present example, the blades of the first cutter 130 are used as a guide for the recording paper 200. However, it may be also possible to provide a movable guide in D-D' direction apart from this.

As mentioned above, it is so configured that the sufficient spaces wherein the recording paper 200 slackens are provided between the color recording starting position (printing position) P1 and the cutting position C1 of the first cutter 130, and between the cutting position C1 of the first cutter 130 and the overcoat recording starting position (printing position) P2, the conveyance roller 116 is installed just ahead the first cutter 130 on the upstream side in the conveyance path, and the conveyance roller 156 is similarly installed just behind the first cutter 130 on the downstream side in the paper-ejection direction (A direction), to control the conveyance to have the recording paper 200 slackened between P1 and C1 and between C1 and P2, it is possible to support the printing operation in a case in which the length of the recording image plane Li is long.

The features of the printer described above is as follows.

The printer whereon the color recording unit (the first printing unit) for recording a plurality of colors and forming an image on a recording paper, and an aftertreatment unit (the second printing unit) for performing an aftertreatment such as application of an overcoat on the recording paper on which color recording has been performed, are arranged along the conveyance direction of the recording paper (recording medium) includes the recording paper cutting unit (cutting unit) for cutting the recording paper on the conveyance path of the recording paper between the color recording unit and the aftertreatment unit.

Further, the printer is characterized in that, after completion of the image forming operation by the color recording unit, the recording paper cutting unit cuts the recording paper, and then the color recording unit performs an image forming operation on a second piece at the same time the aftertreatment unit performs aftertreatment on the recording paper whereon the image has been formed, among the cut recording paper.

Further, the printer includes a control means to perform aftertreatment by the aftertreatment unit on the recording paper whereon the image has been formed without activating the recording paper cutting unit after the image forming operation by the color recording unit ends, when the number of pieces to be recorded is one.

Further, the printer is characterized in that as the recording paper, a roll paper is used.

Further, the printer includes two pairs of conveyance rollers (the third rotation unit and the fourth rotation unit) to nip the recording paper therebetween and convey the recording paper on an upstream side and a downstream side with respect to the recording paper cutting unit in the conveyance direction of the recording paper, and a means to stop the rotations of the two pairs of the conveyance rollers and keep the conveyance rollers in a stopped state.

Further, the printer includes a means to control the pair of the conveyance rollers on the upstream side to rotate in a direction to reverse the recording paper upstream, and the pair of the conveyance rollers on the downstream side to rotate in a direction to convey the recording paper to the downstream side with respect to the conveyance direction of the recording paper, of the two pairs of the conveyance rollers for nipping the recording paper therebetween and conveying the recording paper on the upstream side and the downstream side with respect to the recording paper cutting unit in the conveyance direction of the recording paper, when the recording paper is cut by the recording paper cutting unit.

Further, the printer is characterized in that the color recording unit is installed upstream in the conveyance direction of the recording paper, while the aftertreatment unit is installed downstream in the conveyance direction of the recording paper, and the recording paper is conveyed in the direction to return to the upstream side with respect to the conveyance direction of the recording paper at the time of the image forming operation by the color recording unit, while the recording paper is conveyed to the downstream side in the conveyance direction at the time of the aftertreatment operation by the aftertreatment unit.

Further, the printer is characterized in that in a recording image plane on the recording paper formed by the color recording unit, when referring to a margin on the downstream side as a fore-end margin, and a margin on the upstream side as a tail-end margin in the conveyance direction of the recording paper, the distance between the color recording unit and the recording paper cutting unit is set as long as the sum of a length of the recording image plane and a length of the fore-end margin, and the distance between the recording paper cutting unit and the aftertreatment unit is set as long as the sum of the length of the recording image plane and a length of the tail-end margin.

Further, the aftertreatment unit includes the thermal head to perform the aftertreatment on the image-formed portion on the recording paper by producing an increase in temperature by heat, and a platen roller opposing to the thermal head of the aftertreatment unit. A pair of the conveyance rollers for color recording which conveys the recording paper is installed upstream of the color recording unit. When the color recording operation is performed, the recording paper is conveyed by the pair of the conveyance rollers for color recording, and when the aftertreatment operation is performed, the recording paper is nipped between the thermal head and the platen roller, and is conveyed by driving the platen roller.

Further, the printer is characterized in that the spaces for keeping a slack in the recording paper are provided on the conveyance path of the recording paper between the color recording unit and the recording paper cutting unit, and between the paper cutting unit and the aftertreatment unit, wherein the recording paper is conveyed to the aftertreatment unit after the image forming by the color recording unit ends, and the recording paper is cut by the recording paper cutting means after the recording paper is slackened in the spaces for keeping the slack in the recording paper.

Further, the printer is characterized in that a second recording paper cutting unit (margin cutting unit) for cutting margins of the recording paper is provided on the downstream side of the aftertreatment unit.

Further, the color recording unit consists of an ink ribbon composed of a plurality of colors, and the thermal head for color recording which produces an increase in temperature of the ink ribbon by heat and performs image forming, whereas the aftertreatment unit consists of an ink ribbon whereto an overcoat agent is applied, and the thermal head for aftertreatment which produces an increase in temperature of the ink ribbon by heat to have it applied to the image-formed portion on the recording paper.

The third rotation unit (conveyance roller 116) nips the printing medium (recording paper 200) conveyed by the first rotation unit (grip roller 115) between the rollers, conveys the printing medium (recording paper 200) to the prescribed cutting position by rotating the rollers in the prescribed direction (F direction) and fixes the printing medium, and the first rotation unit (grip roller 115) conveys the printing medium (recording paper 200) to the prescribed printing starting position by rotating the rollers in the prescribed direction (F direction) after the third rotation unit (conveyance roller 116) fixes the printing medium (recording paper 200), and generates a slack in the printing medium (recording paper 200) between the third nip position (R3) at which the third rotation unit (conveyance roller 116) nips the printing medium (recording paper 200) and the first printing position (R1).

The second printing unit (overcoat recording unit 140) performs printing on the printing medium (recording medium 200) while the printing head (thermal head 144) and the platen roller 145 nip the printing medium (recording paper 200) conveyed to the prescribed printing starting position by the first rotation unit (grip roller 115) and conveys the printing medium (recording paper 200) to the prescribed printing ending position by rotating the platen roller 145, and the fourth rotation unit (conveyance roller 156) conveys the printing medium (recording paper 200) to the prescribed cutting position by rotating the rollers in the prescribed direction (F direction) at a speed faster than the platen roller 145 after the second printing unit (overcoat recording unit 140) nips the printing medium (recording paper 200), and generates a slack in the printing medium (recording paper 200) between the second printing position (P2) at which the second printing unit (overcoat recording unit 140) performs printing on the printing medium (recording paper 200) and the fourth nip position (R4) at which the fourth rotation unit (conveyance roller 156) nips the printing medium (recording paper 200).

Description of the Reference Numerals

Figure 1:
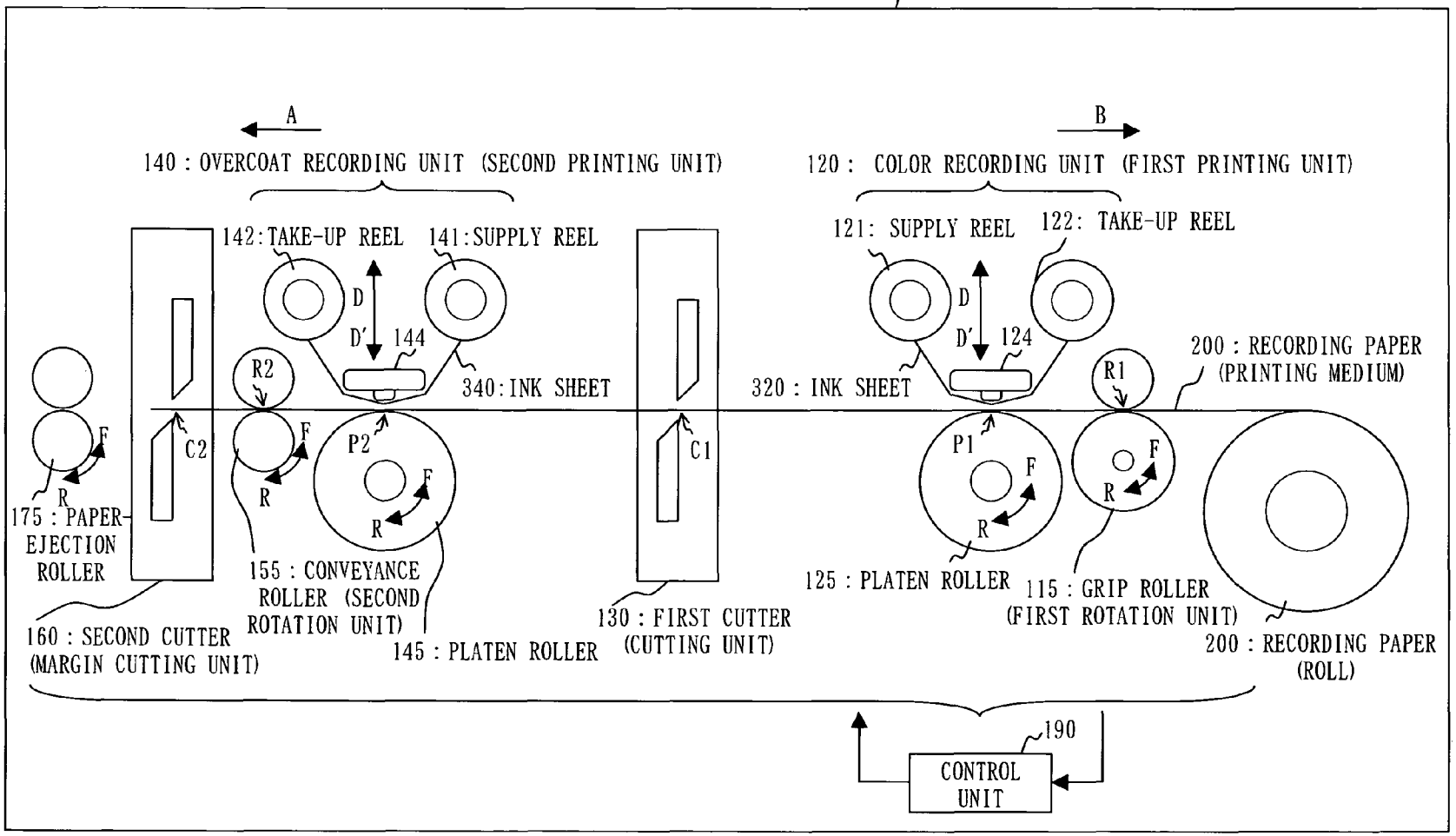
[FIG. 1] A diagram describing one example of the structure of the main parts in the printer 100 according to the first embodiment.
Figure 2:
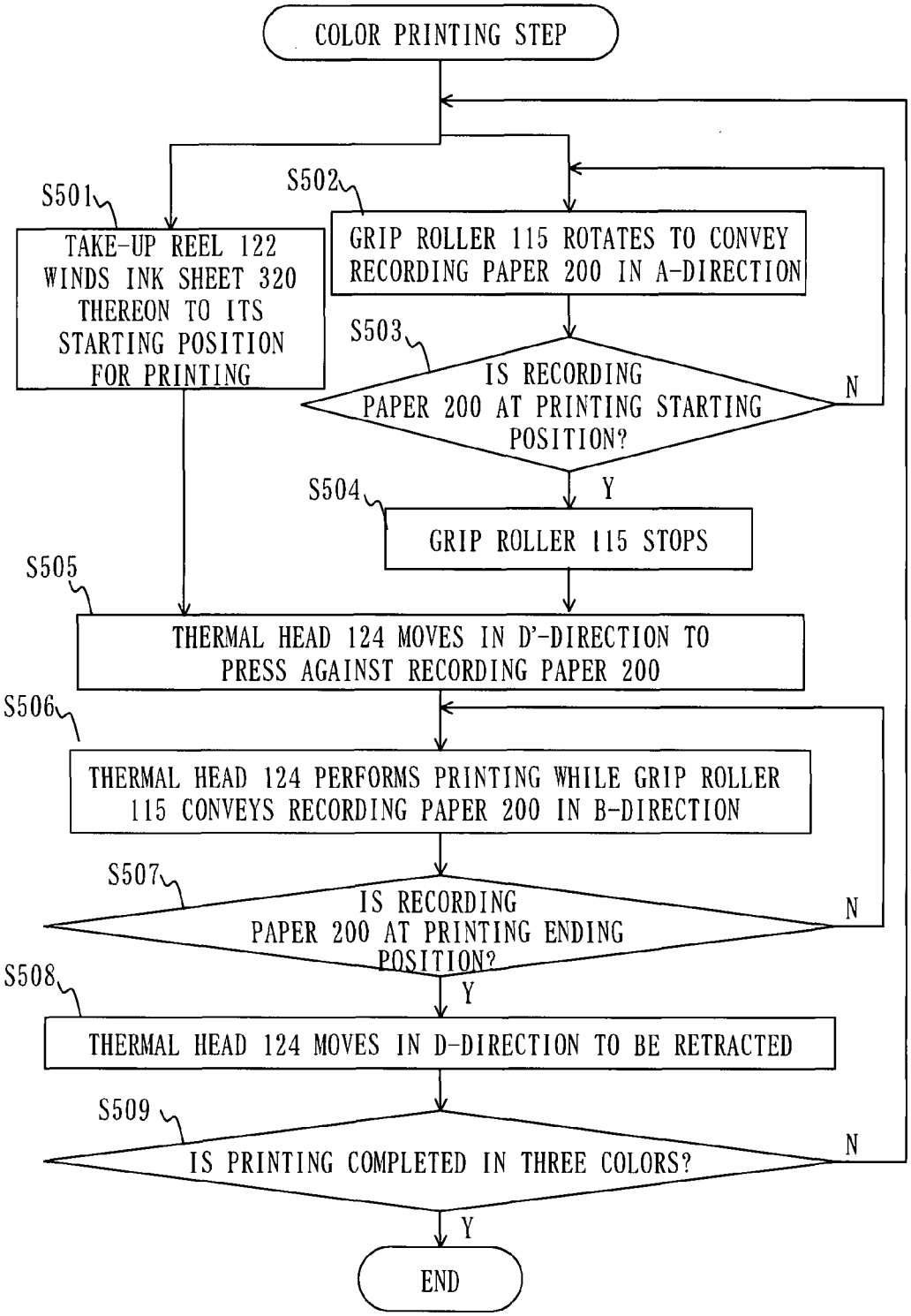
[FIG. 2] A flowchart describing one example of the flow of the operations of the printer 100 in the color printing step according to the first embodiment.
Figure 3:
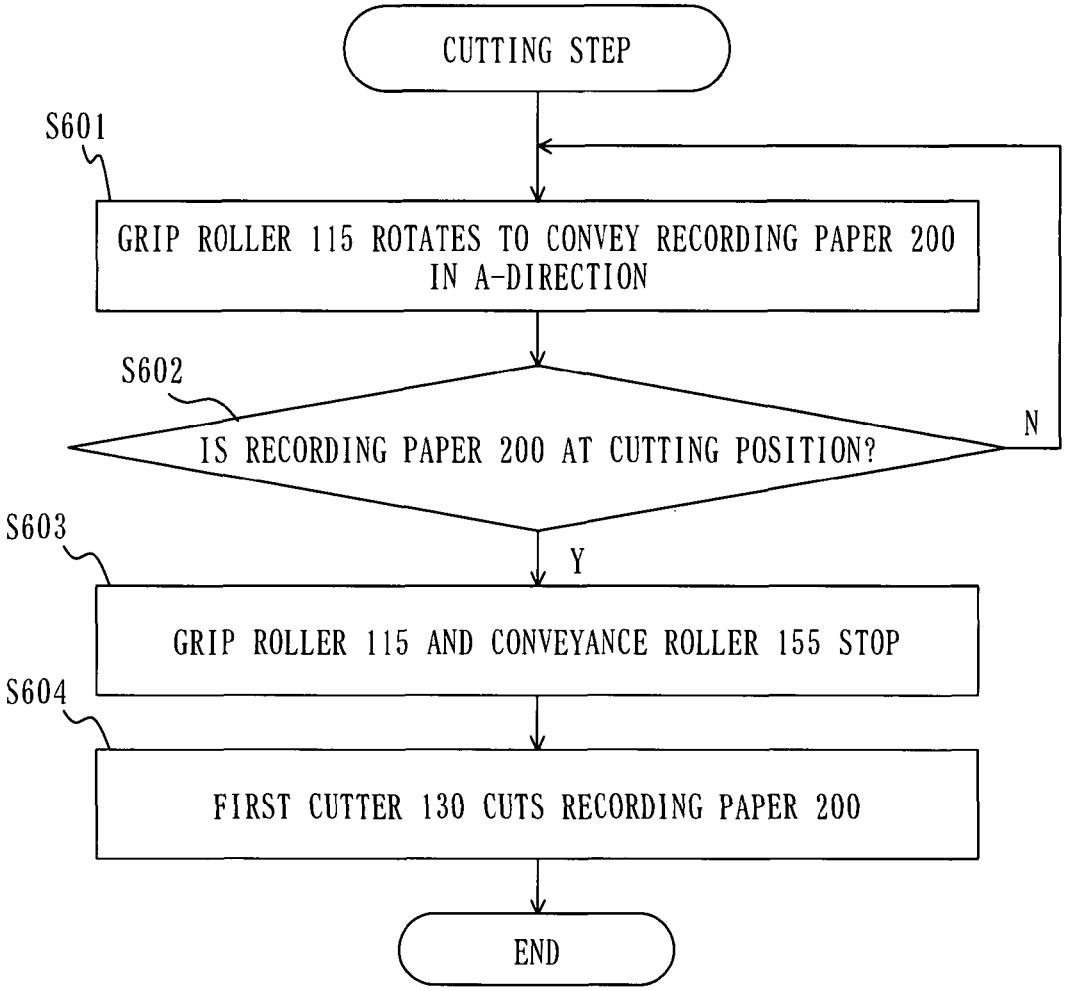
[FIG. 3] A flowchart describing one example of the flow of the operations of the printer 100 in the cutting step according to the first embodiment.
Figure 4:
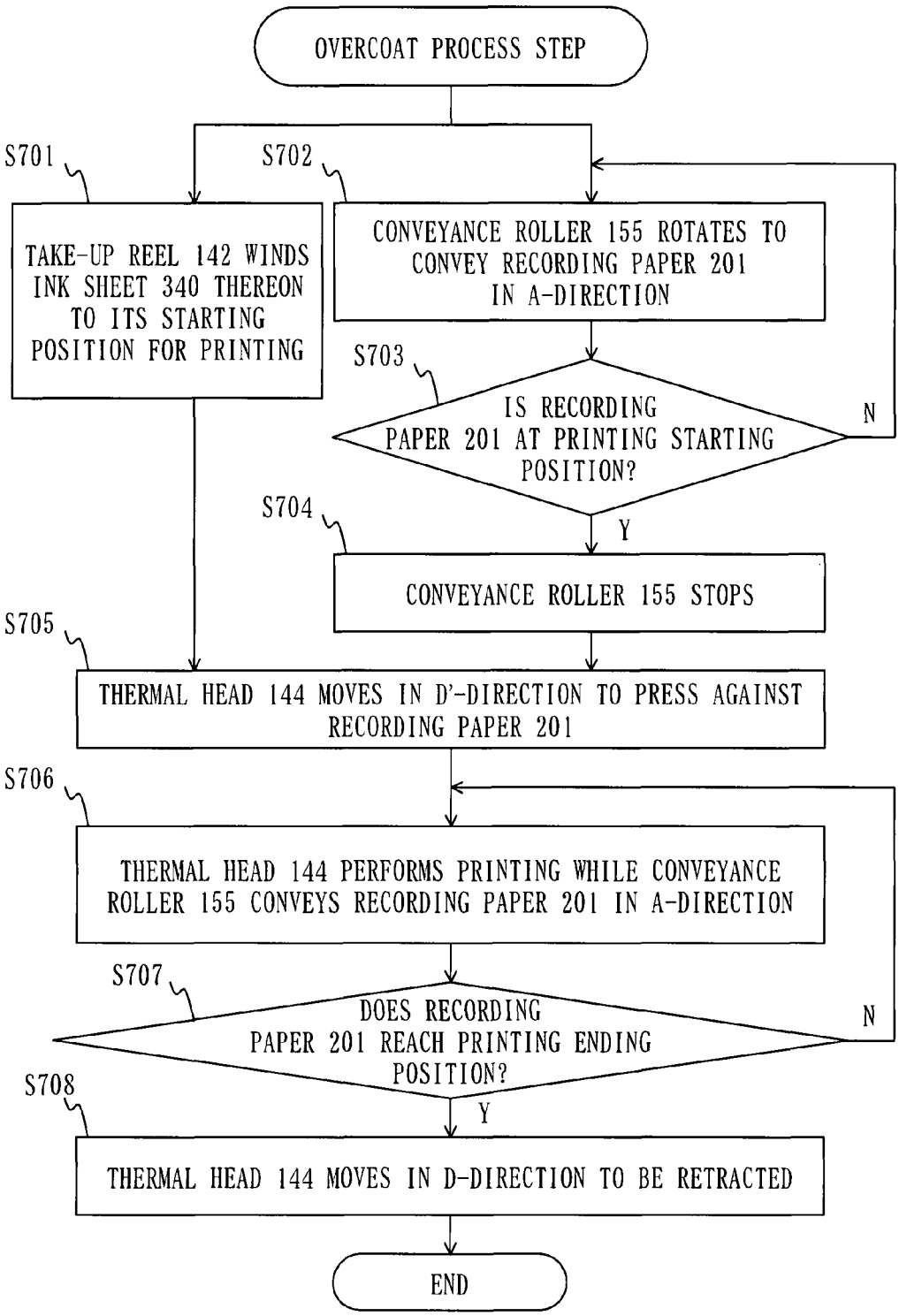
[FIG. 4] A flowchart describing one example of the flow of the operations of the printer 100 in the overcoat process step according to the first embodiment.
Figure 5:
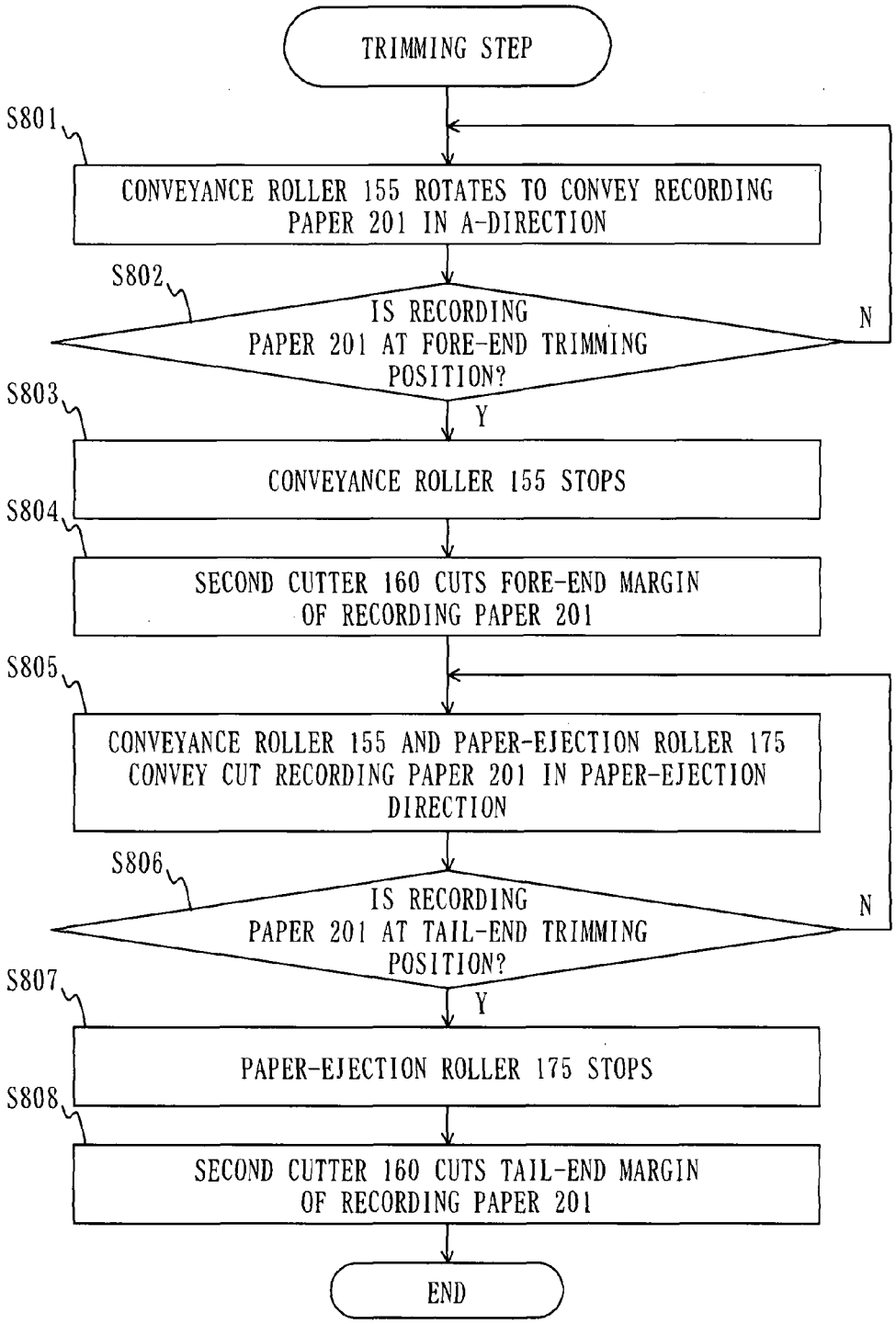
[FIG. 5] A flowchart describing one example of the flow of the operations of the printer 100 in the trimming step according to the first embodiment.
Figure 6:
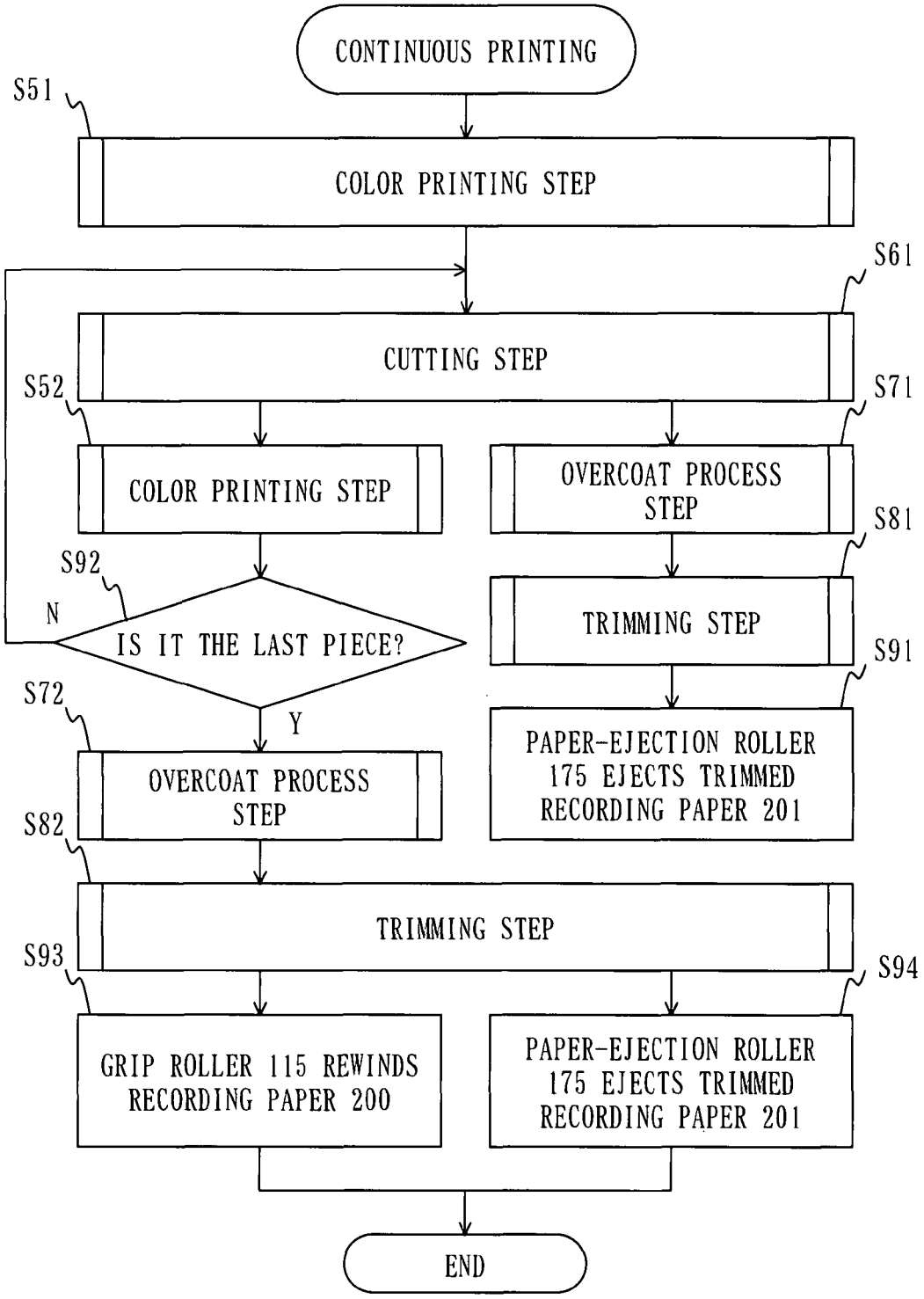
[FIG. 6] A flowchart describing one example of the flow of the operations when the printer 100 performs the continuous printing process according to the first embodiment.
Figure 7:
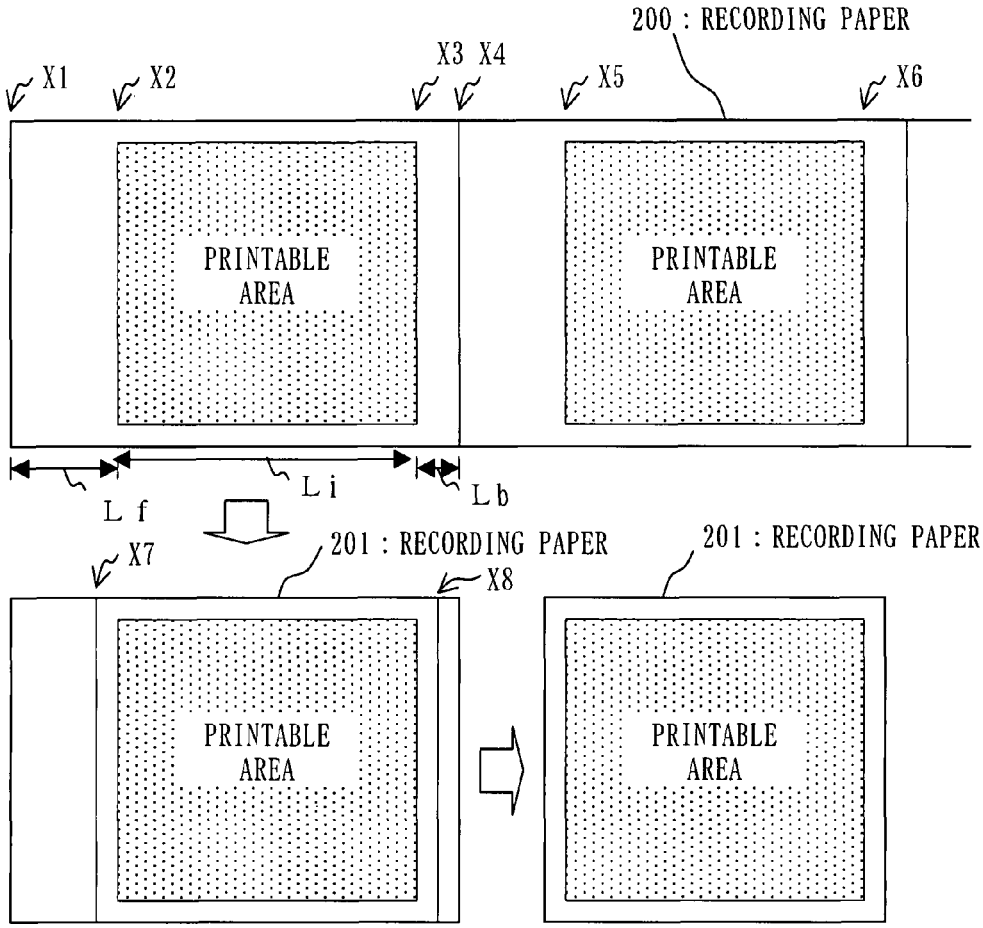
[FIG. 7] A diagram describing one example of the printable areas on the recording paper 200 according to the first embodiment.
Figure 8:
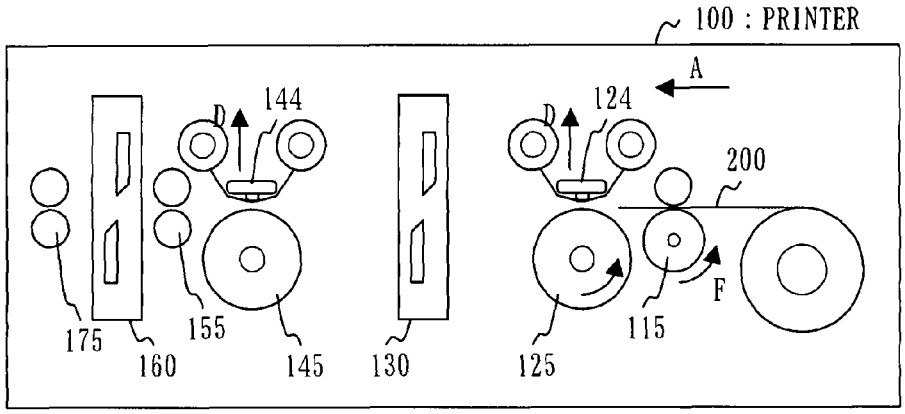
[FIG. 8] A diagram describing one example of the state of the printer 100 in each step of the process according to the first embodiment.
Figure 9:
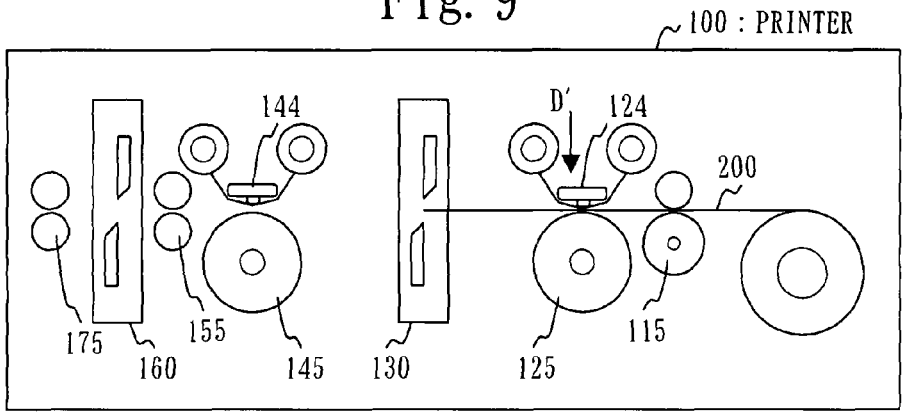
[FIG. 9] A diagram describing one example of the state of the printer 100 in each step of the process according to the first embodiment.
Figure 10:
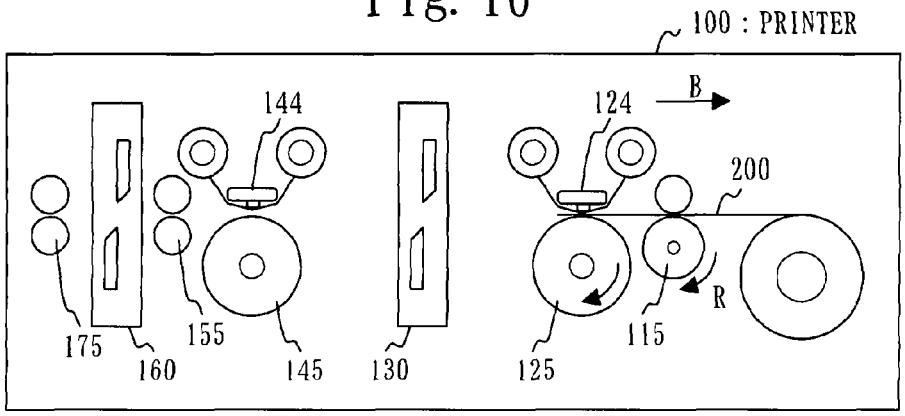
[FIG. 10] A diagram describing one example of the state of the printer 100 in each step of the process according to the first embodiment.
Figure 11:
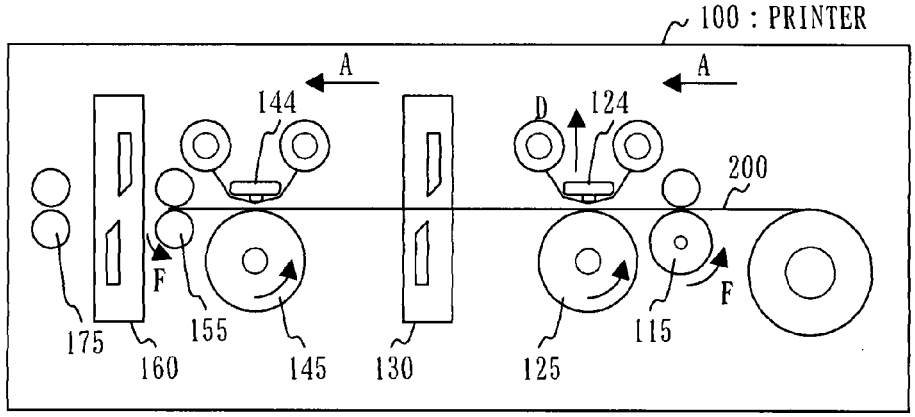
[FIG. 11] A diagram describing one example of the state of the printer 100 in each step of the process according to the first embodiment.
Figure 12:
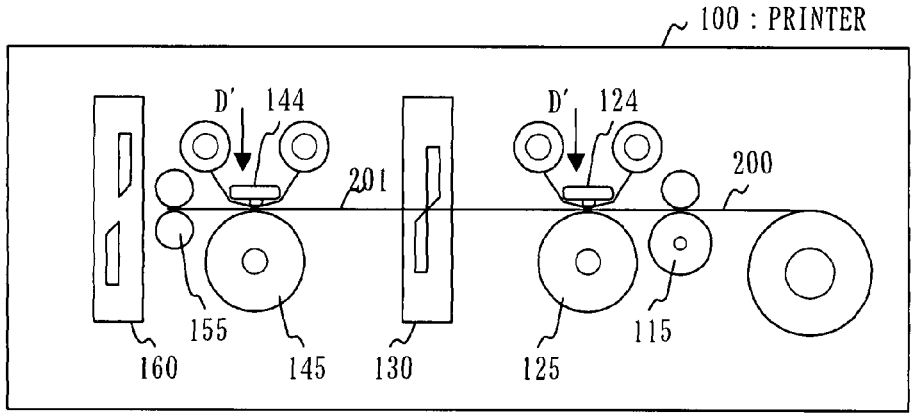
[FIG. 12] A diagram describing one example of the state of the printer 100 in each step of the process according to the first embodiment.
Figure 13:
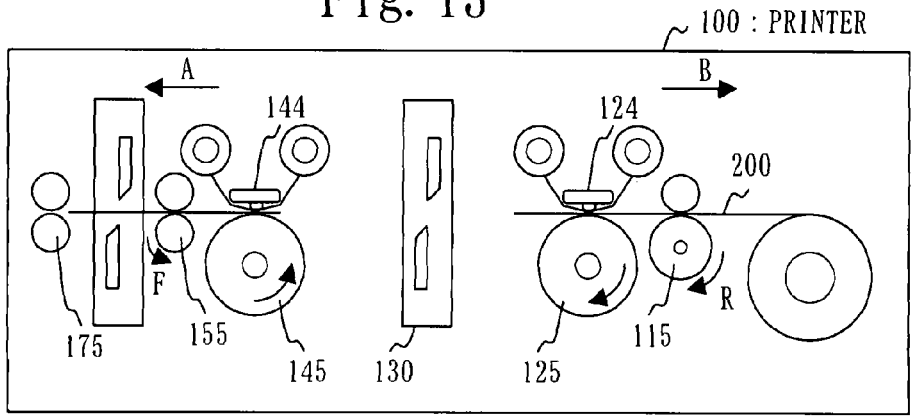
[FIG. 13] A diagram describing one example of the state of the printer 100 in each step of the process according to the first embodiment.
Figure 14:
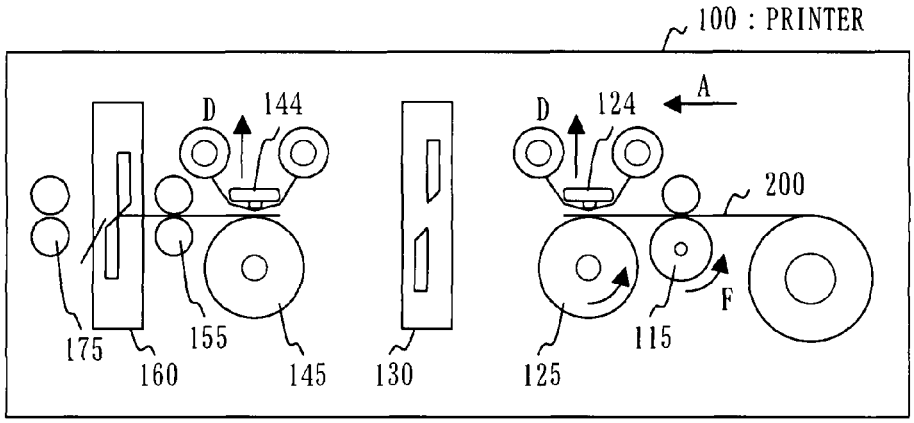
[FIG. 14] A diagram describing one example of the state of the printer 100 in each step of the process according to the first embodiment.
Figure 15:
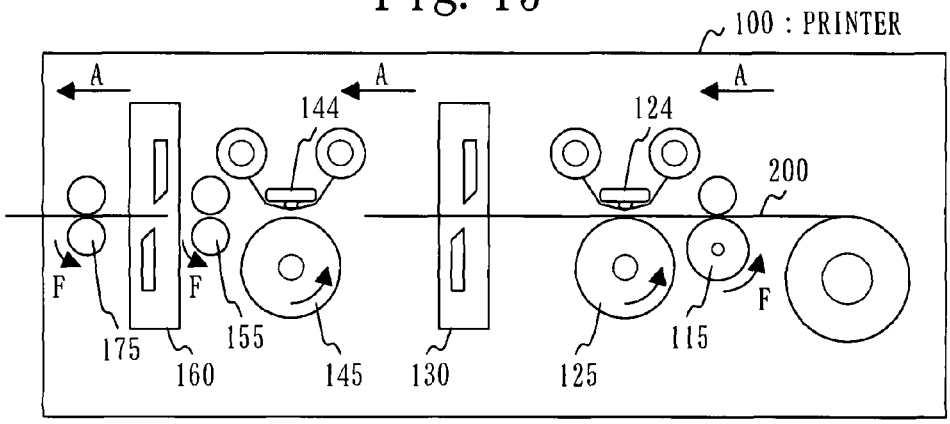
[FIG. 15] A diagram describing one example of the state of the printer 100 in each step of the process according to the first embodiment.
Figure 16:
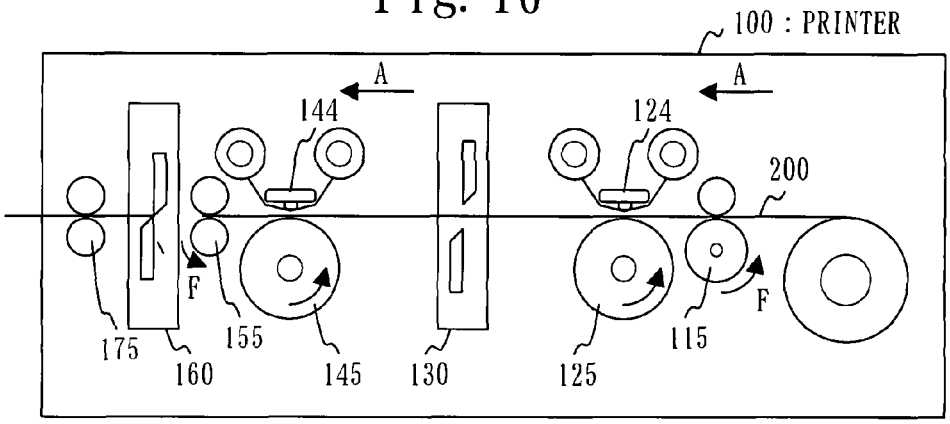
[FIG. 16] A diagram describing one example of the state of the printer 100 in each step of the process according to the first embodiment.
Figure 17:
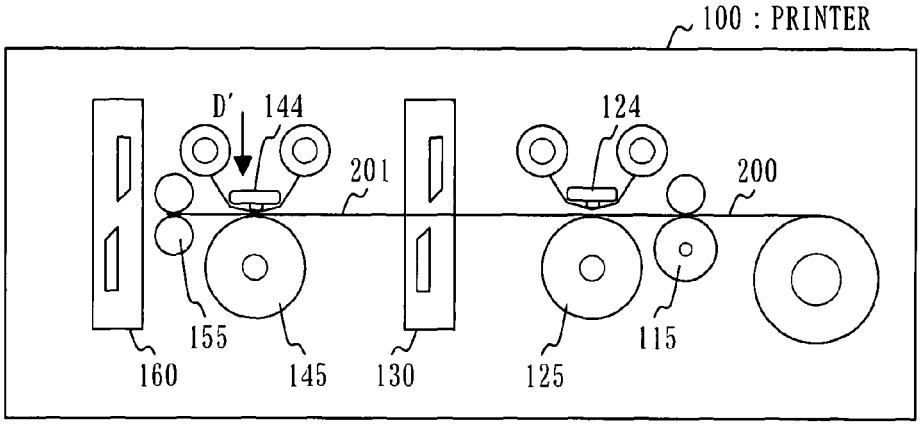
[FIG. 17] A diagram describing one example of the state of the printer 100 in each step of the process according to the first embodiment.
Figure 18:
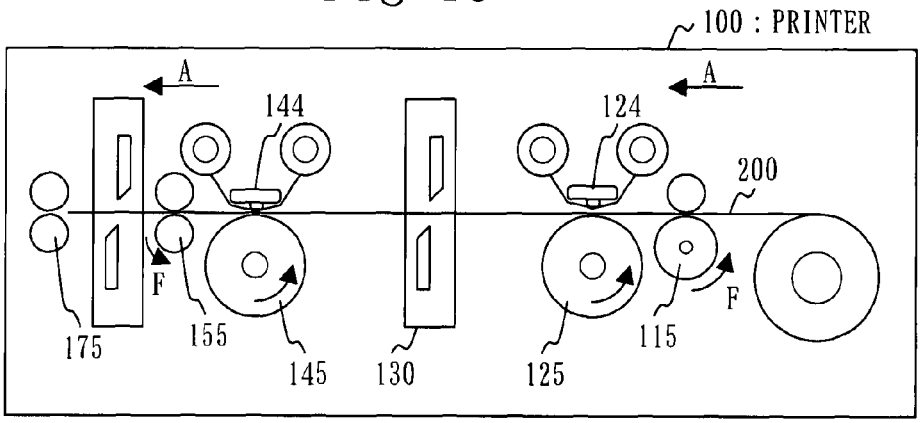
[FIG. 18] A diagram describing one example of the state of the printer 100 in each step of the process according to the first embodiment.
Figure 19:
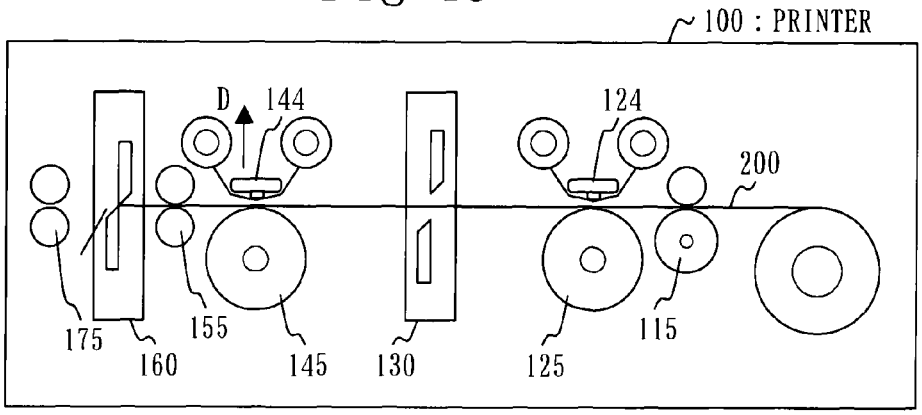
[FIG. 19] A diagram describing one example of the state of the printer 100 in each step of the process according to the first embodiment.
Figure 20:
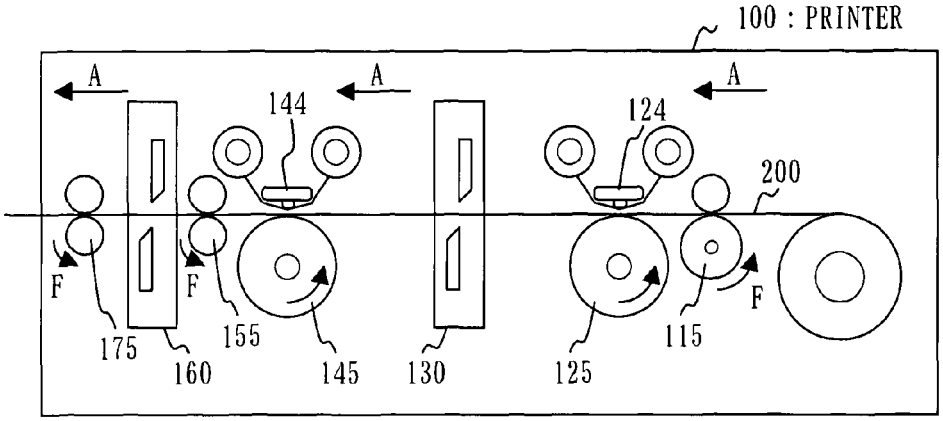
[FIG. 20] A diagram describing one example of the state of the printer 100 in each step of the process according to the first embodiment.
Figure 21:
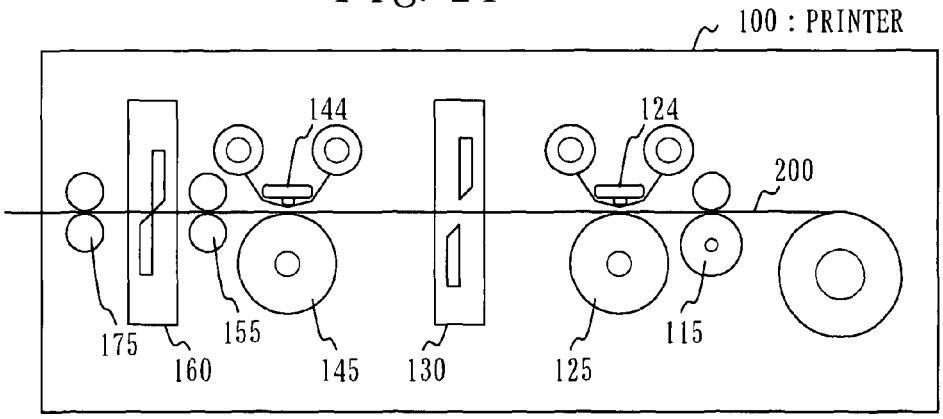
[FIG. 21] A diagram describing one example of the state of the printer 100 in each step of the process according to the first embodiment.
Figure 22:
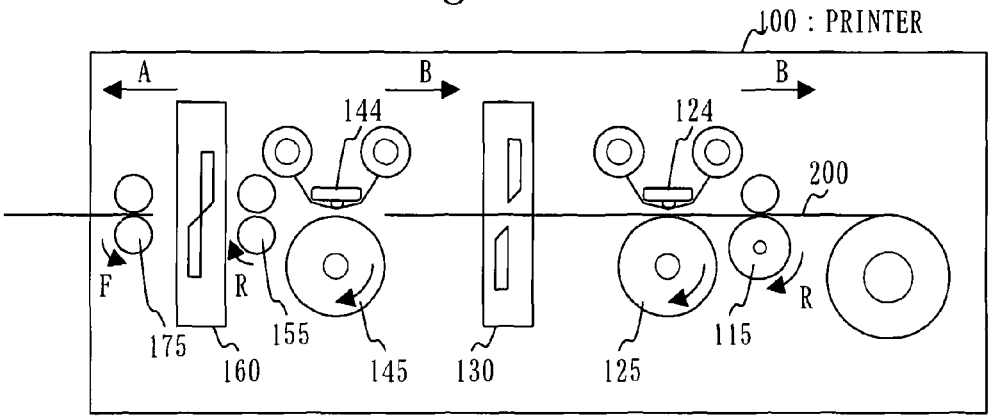
[FIG. 22] A diagram describing one example of the state of the printer 100 in each step of the process according to the first embodiment.
Figure 23:
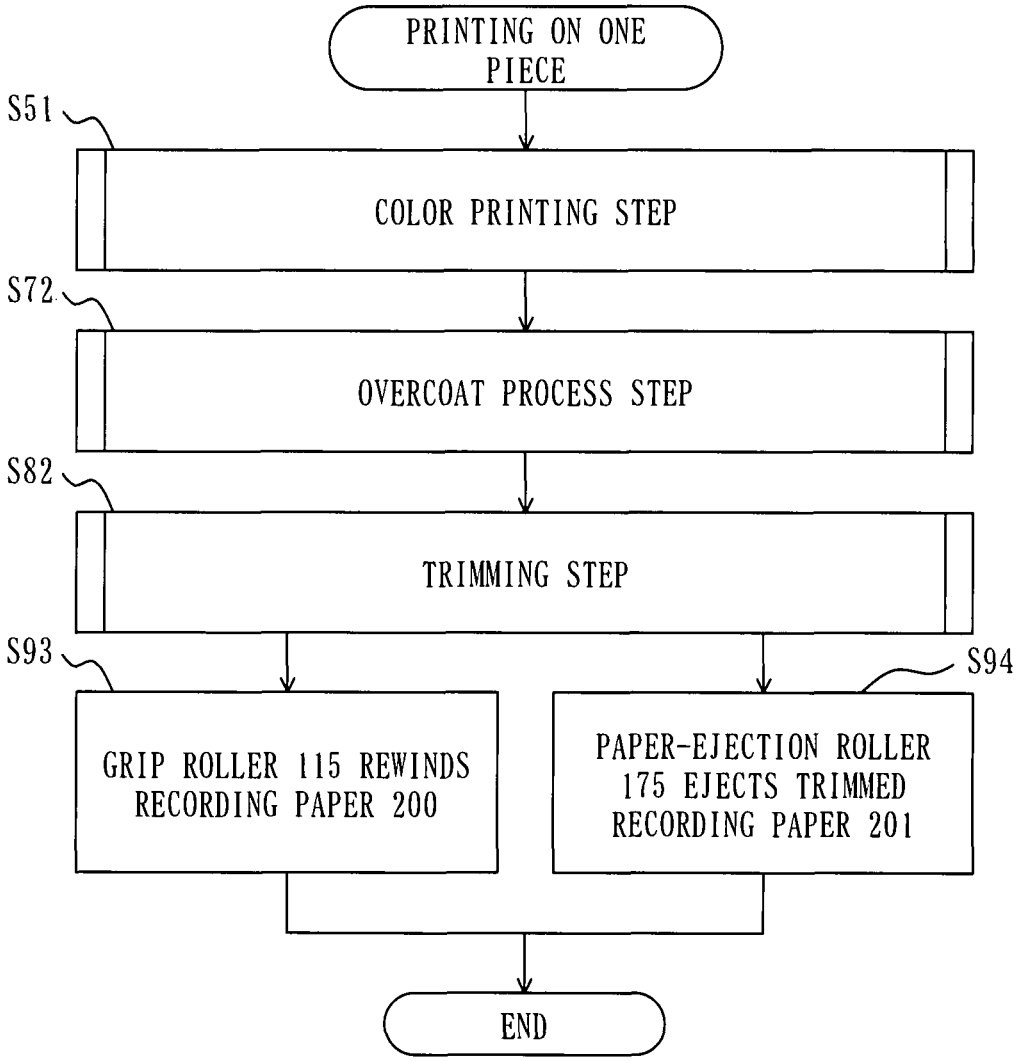
[FIG. 23] A flowchart describing one example of the flow of the operations when the printer 100 performs printing on one piece according to the first embodiment.
Figure 24:
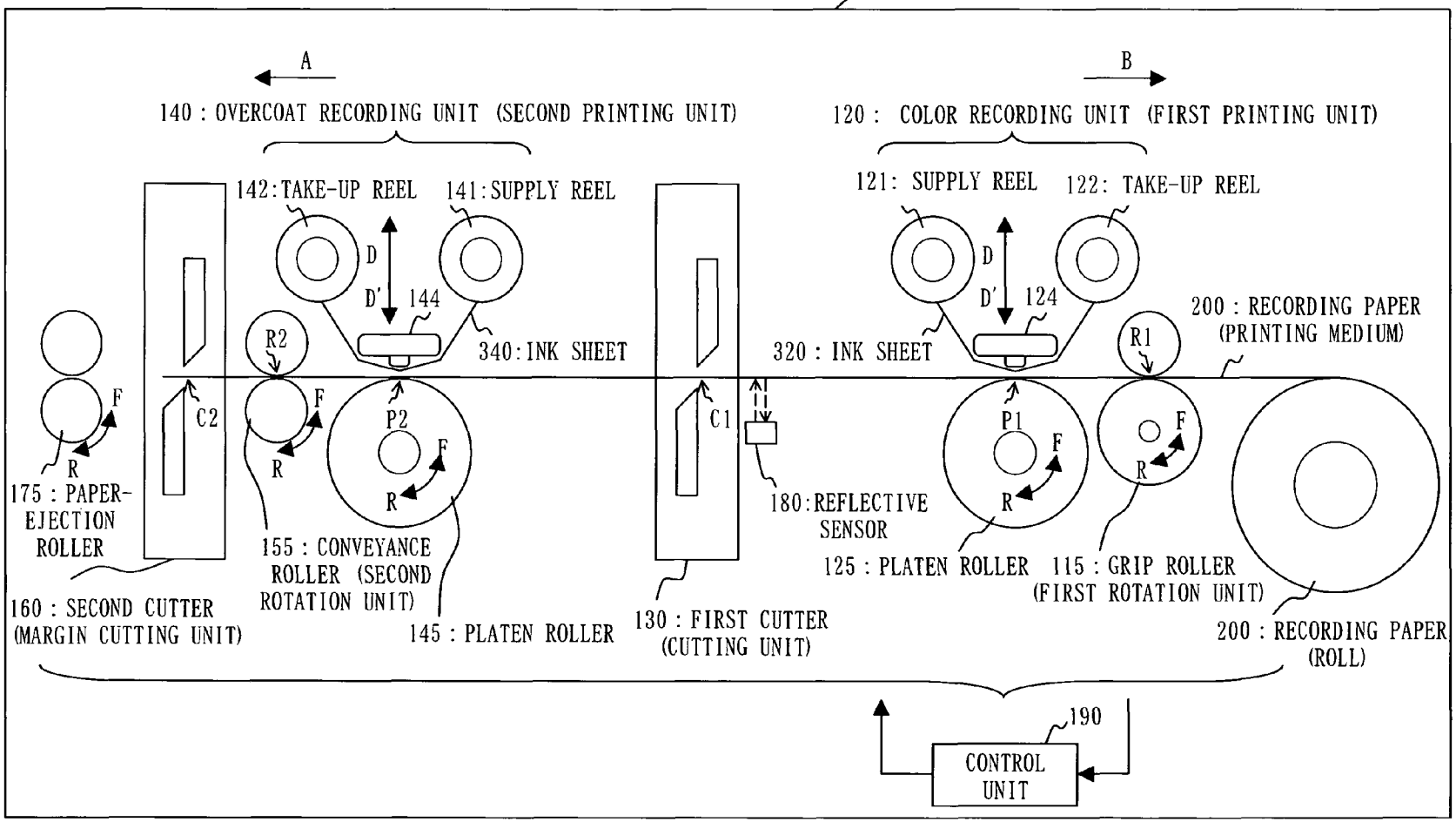
[FIG. 24] A diagram describing another example of the structure of the main parts of the printer 100 according to the first embodiment.
Figure 25:
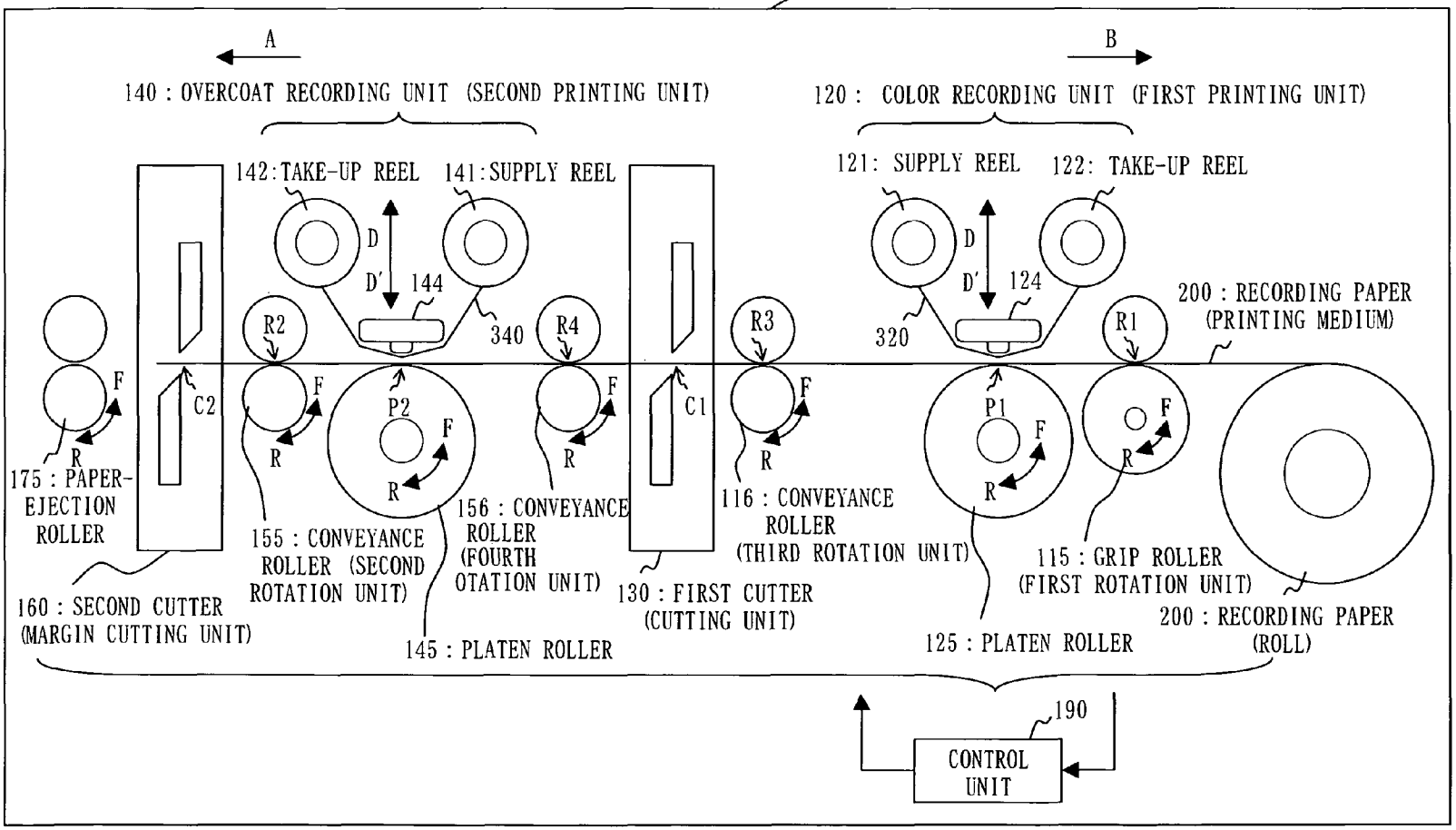
[FIG. 25] A diagram describing one example of the structure of the main parts of the printer 100 according to the second embodiment.
Figure 26:
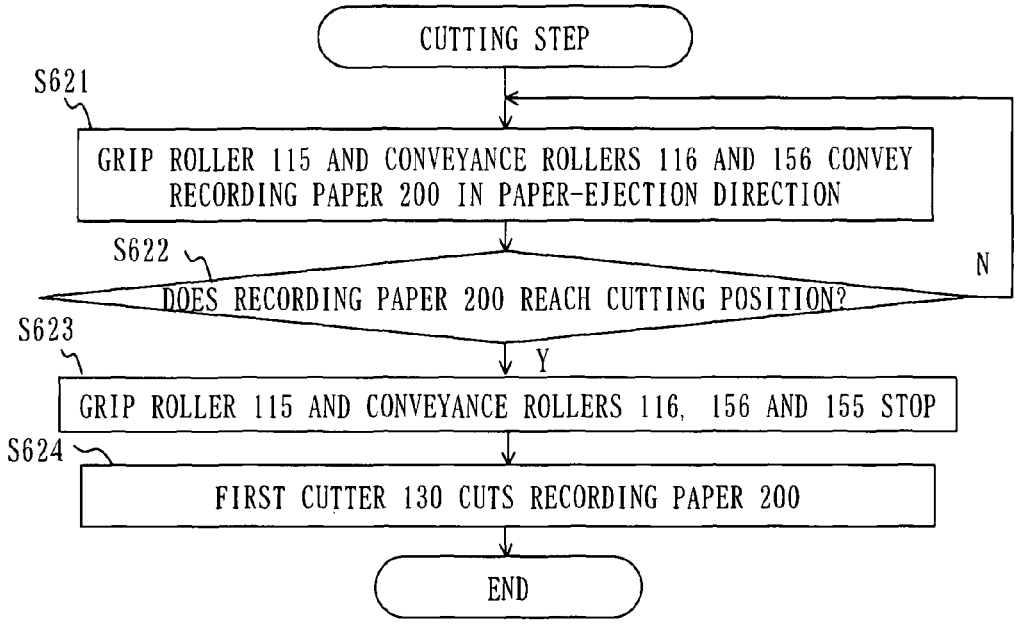
[FIG. 26] A flowchart describing one example of the flow of the operations of the printer 100 in the cutting step according to the second embodiment.
Figure 27:
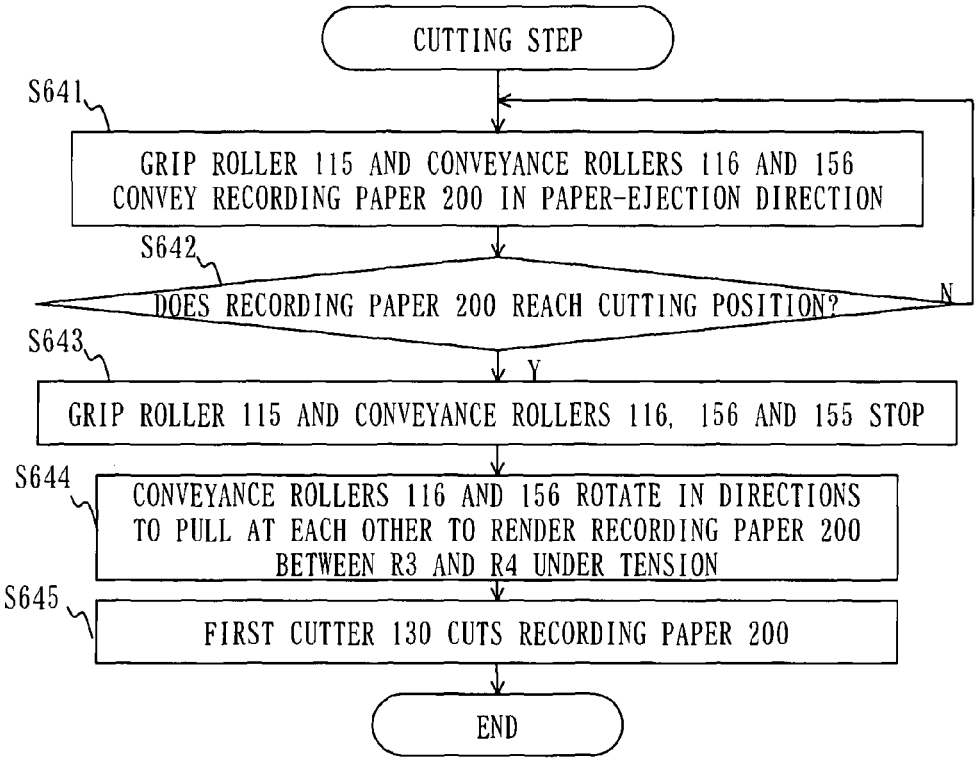
[FIG. 27] A flowchart describing another example of the flow of the operations of the printer 100 in the cutting step according to the second embodiment.
Figure 28:
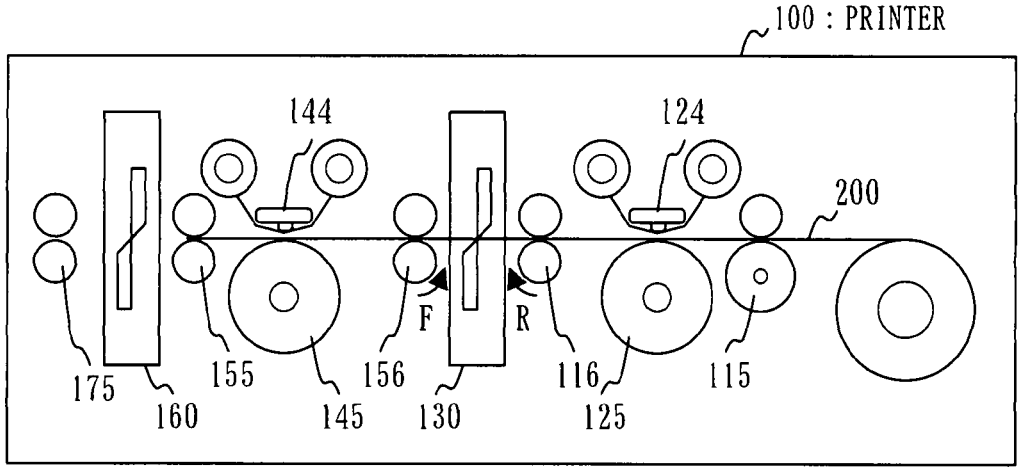
[FIG. 28] A diagram describing one example of the state of the printer 100 in the cutting step according to the second embodiment.
Figure 29:
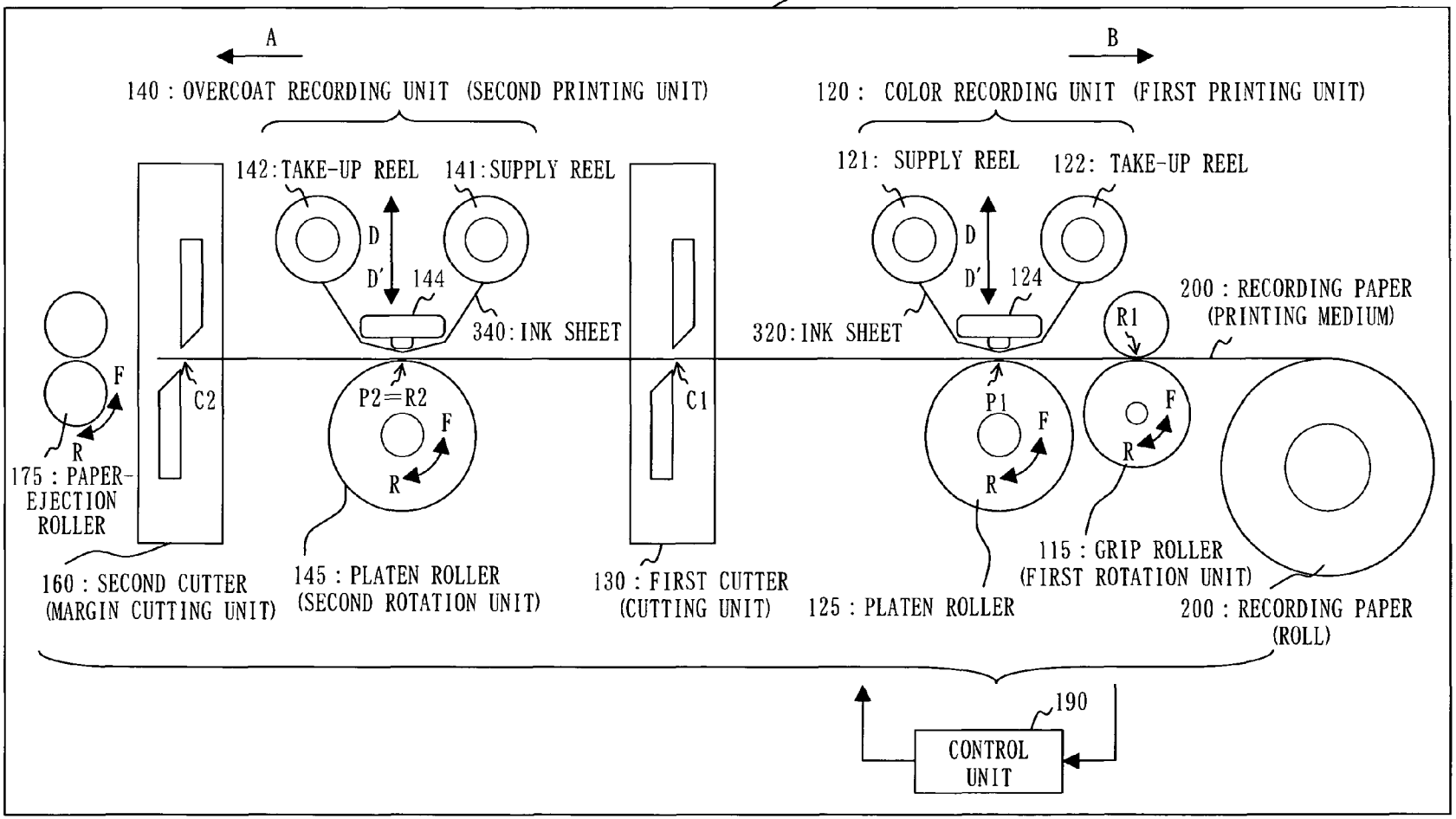
[FIG. 29] A diagram describing one example of the structure of the main parts of the printer 100 according to the third embodiment.
Figure 30:
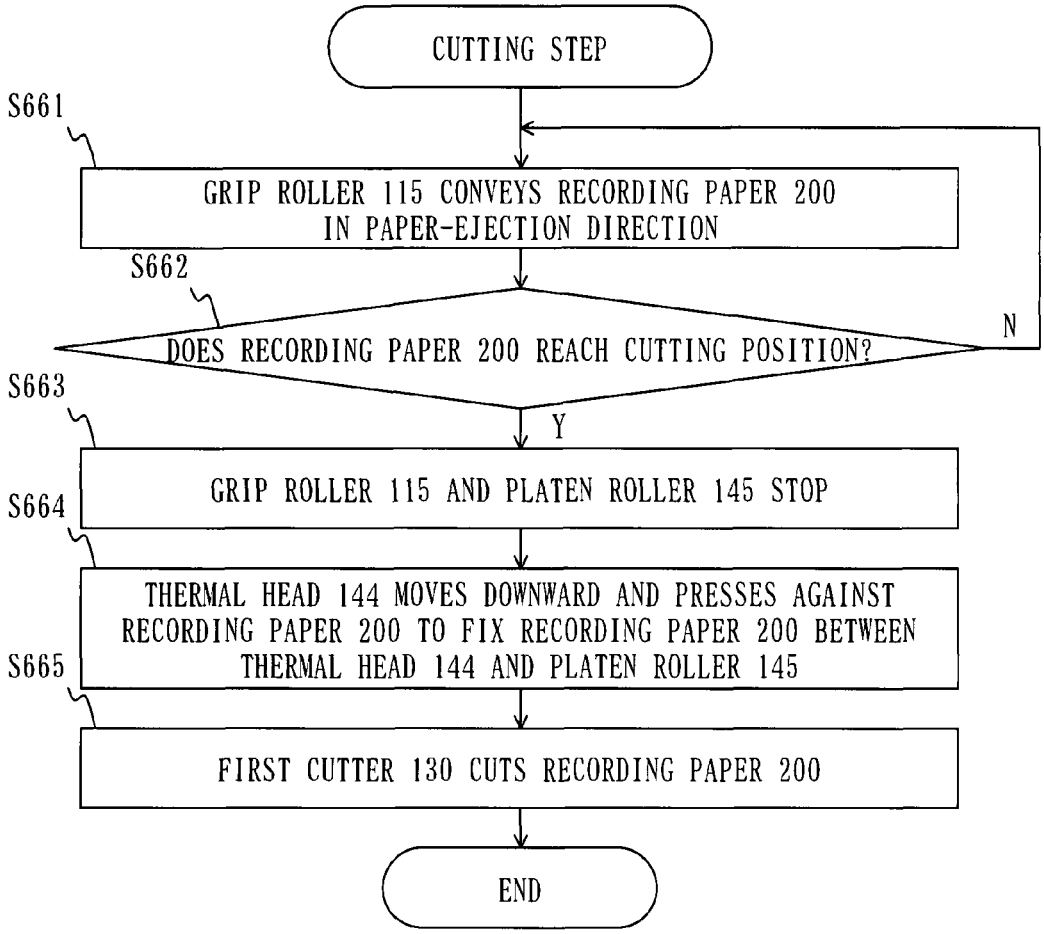
[FIG. 30] A flowchart describing one example of the flow of the operations of the printer 100 in the cutting step according to the third embodiment.
Figure 31:
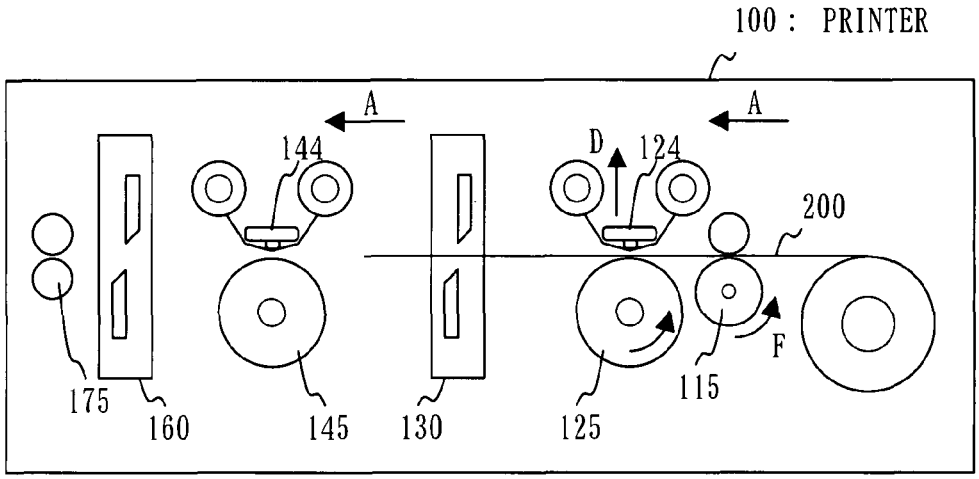
[FIG. 31] A diagram describing one example of the state of the printer 100 in each step of the process according to the third embodiment.
Figure 32:
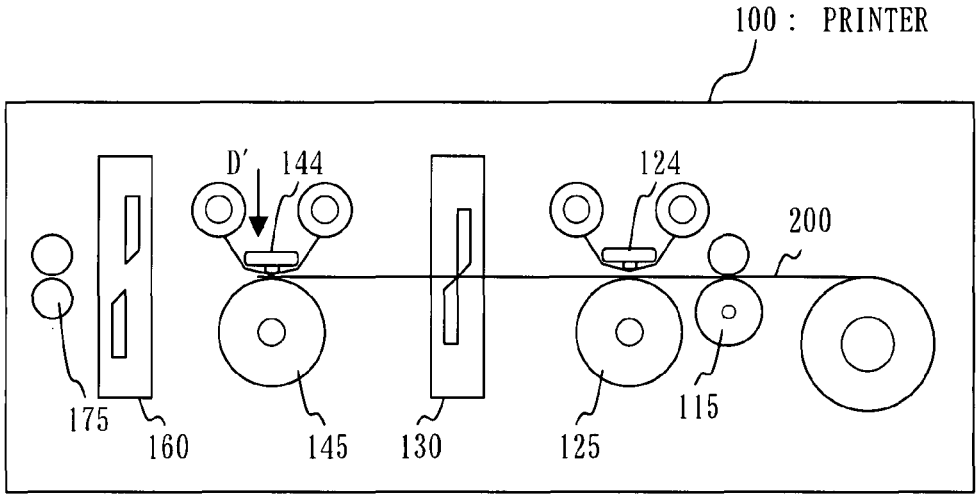
[FIG. 32] A diagram describing one example of the state of the printer 100 in each step of the process according to the third embodiment.
Figure 33:
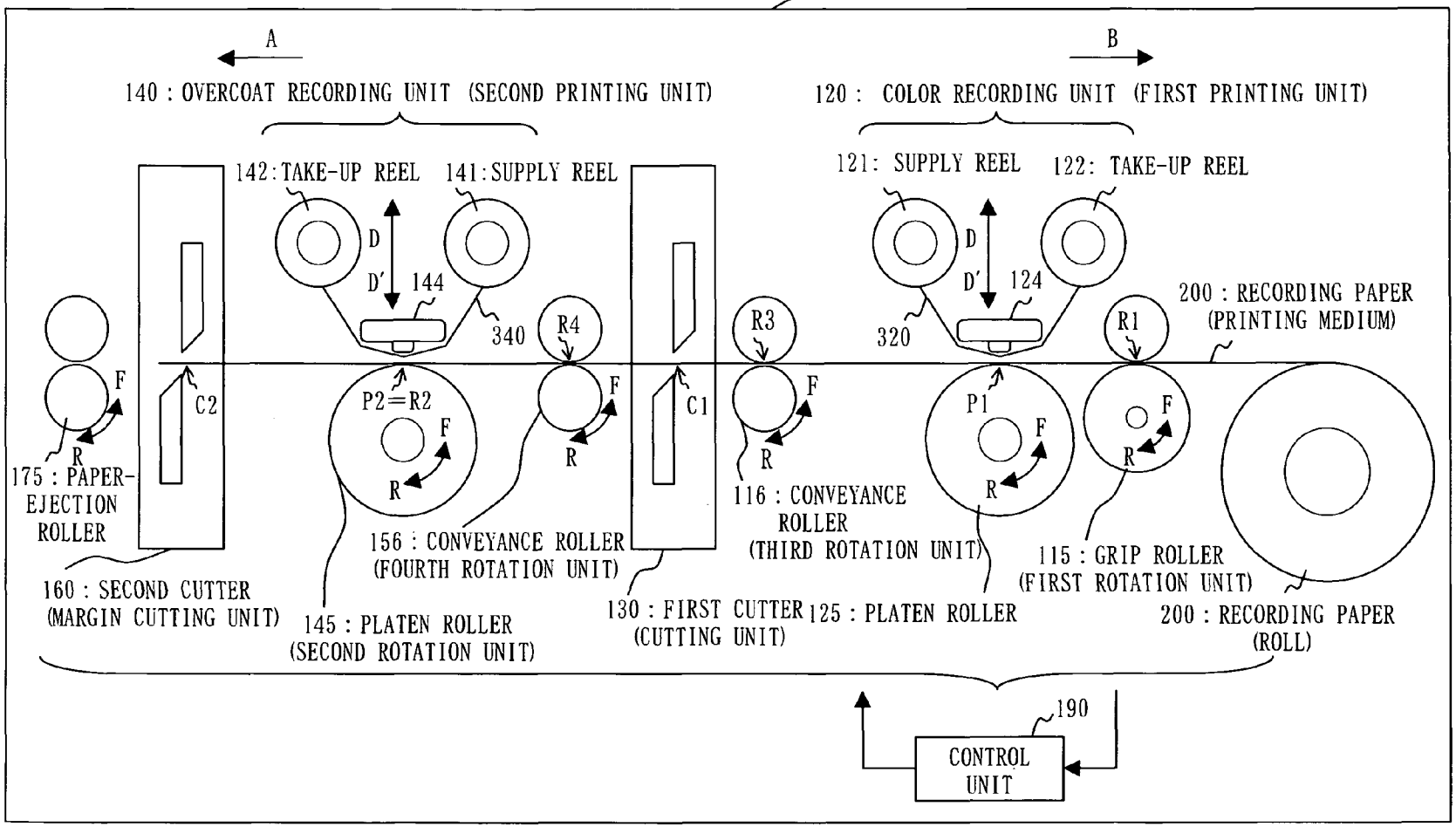
[FIG. 33] A diagram describing one example of the structure of the main parts of the printer 100 according to the fourth embodiment.
Figure 34:
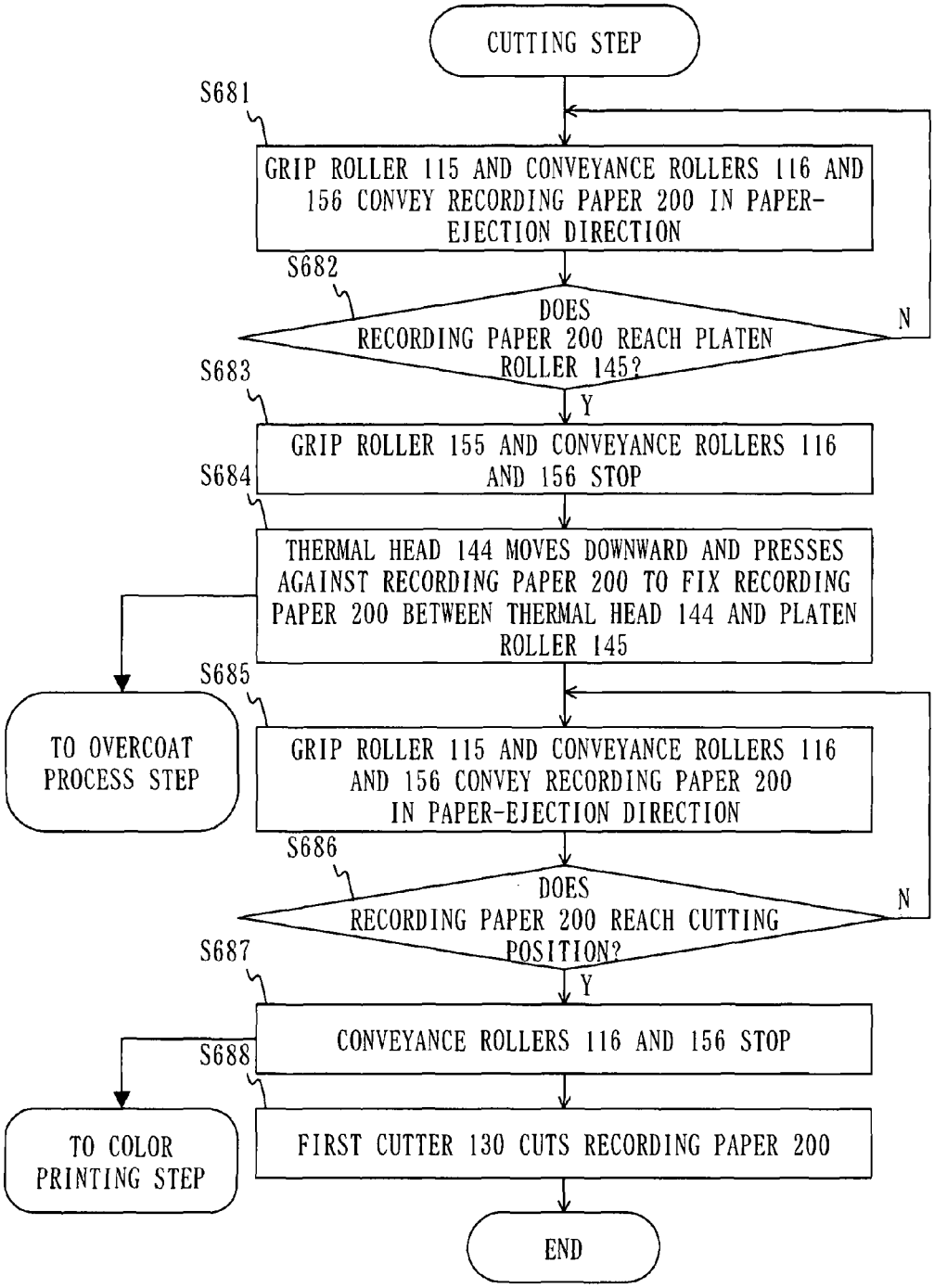
[FIG. 34] A flowchart describing one example of the flow of the operations of the printer 100 in the cutting step according to the fourth embodiment.
Figure 35:
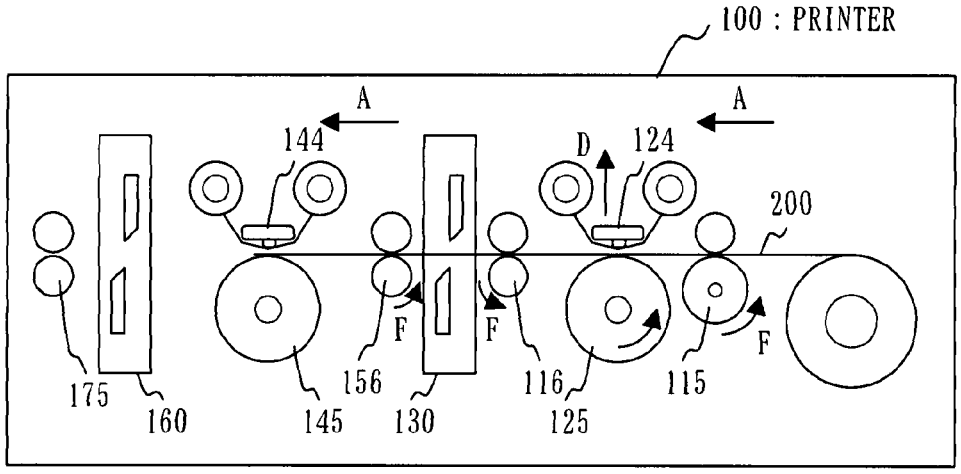
[FIG. 35] A diagram describing one example of the state of the printer 100 in each step of the process according to the fourth embodiment.
Figure 36:
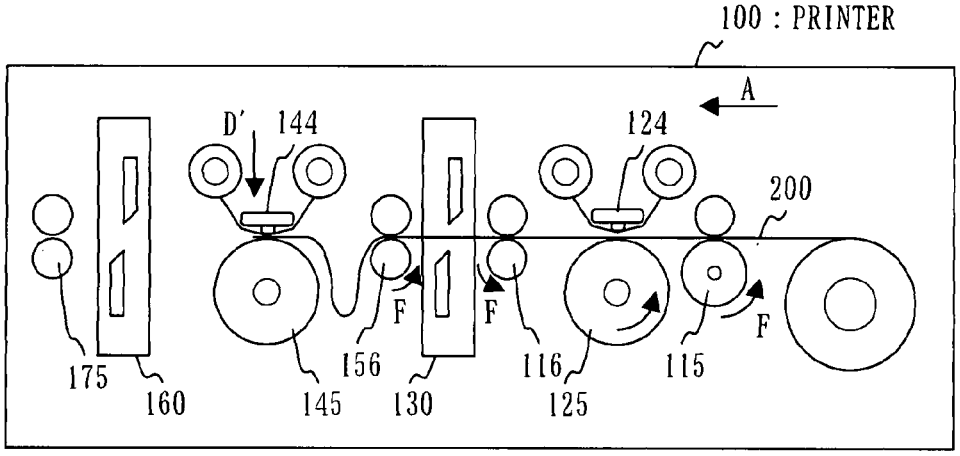
[FIG. 36] A diagram describing one example of the state of the printer 100 in each step of the process according to the fourth embodiment.
Figure 37:
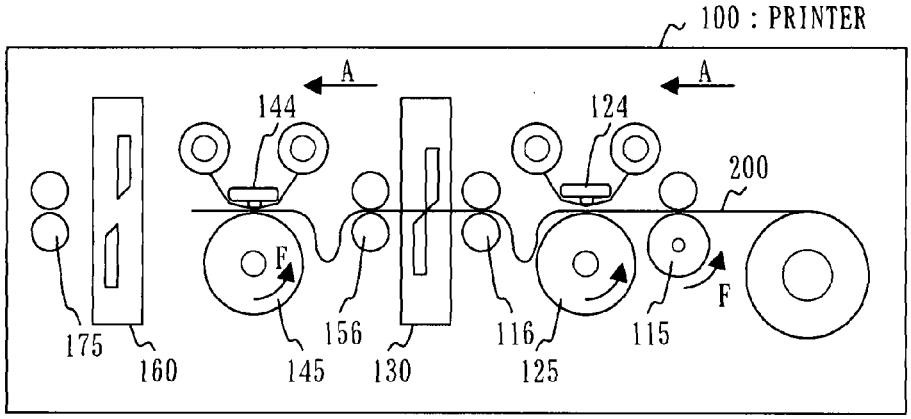
[FIG. 37] A diagram describing one example of the state of the printer 100 in each step of the process according to the fourth embodiment.
Figure 38:
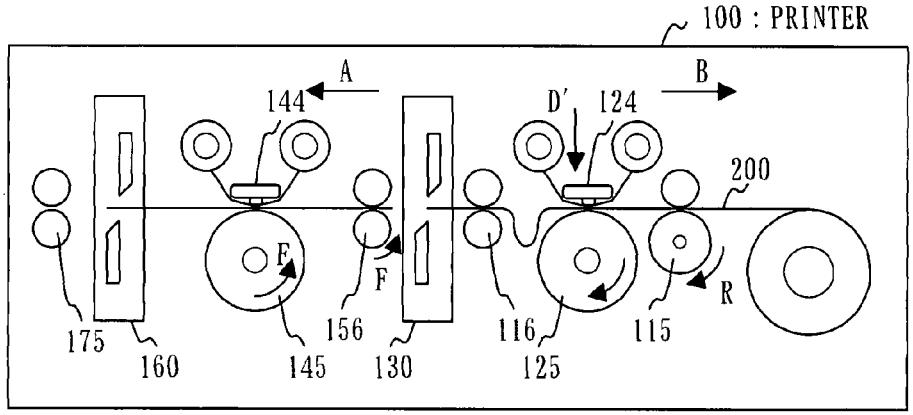
[FIG. 38] A diagram describing one example of the state of the printer 100 in each step of the process according to the fourth embodiment.
Figure 39:
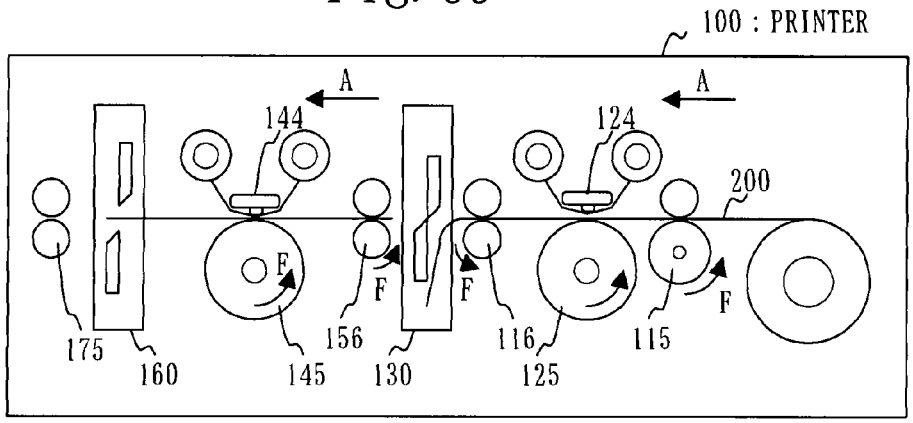
[FIG. 39] A diagram describing one example of the state of the printer 100 in each step of the process according to the fourth embodiment.

100: Printer, 115: Grip roller, 116, 155 and 156: Conveyance roller, 120: Color recording unit, 121 and 141: Supply reel, 122 and 142: Take-up reel, 124 and 144: Thermal head, 125 and 145: Platen roller, 130: The first cutter, 160: The second cutter, 175: Paper-ejection roller, 190: Control unit, 200 and 201: Recording paper, 320 and 340: Ink sheet.

The invention claimed is:

1. A printing device comprising:

a control unit;

a first printing unit, controlled by the control unit, to perform printing at a predetermined first printing position on a convey path for an elongated printing medium by a first printing step on the printing medium;

a cutting unit, controlled by the control unit, to cut apart a portion of the printing medium on which the printing has been performed by the first printing unit, as a printing medium strip by cutting the printing medium at a predetermined cutting position, on the convey path, located in a first direction to convey the printing medium with respect to the first printing position;

a second printing unit, controlled by the control unit, to perform an overcoat printing process by a second printing step on the printing medium strip cut apart by the cutting unit, at a predetermined second printing position, on the convey path, located in the first direction with respect to the cutting position, the second printing step being performed in parallel with a next printing by the first printing unit, on the printing medium from which the printing medium strip has been cut apart;

a first rotation unit controlled by the control unit, to nip the printing medium, and to convey the printing medium by rotating, at a predetermined first nip position, on the convey path, located in a second direction opposite to the first direction with respect to the first printing position, the first rotation unit serving to convey the printing medium before the printing by the first printing unit, in the first direction until a printing start point on the printing medium coincides with the first printing position, serving to convey the printing medium in the second direction after the first printing unit starts the printing until a printing end point on the printing medium comes to the first printing position, and serving to convey the printing medium in the first direction after the first printing unit ends the printing on the printing medium; and a second rotation unit controlled by the control unit, to nip a portion of the printing medium which is to become the printing medium strip upon being cut by the cutting unit, at a second nip position, on the convey path, located at one of the same position as the second printing position and a position located in the first direction with respect to the second printing position, and to convey, by rotating, the printing medium and the printing medium strip cut apart from the printing medium by the cutting unit, the second rotation unit serving to nip the printing medium on which the first printing unit performs printing and which is conveyed by the first rotation unit, and serving to convey the printing medium strip cut apart by the cutting unit, in the first direction after the second printing unit starts printing.

2. The printing device according to claim 1, wherein a distance between the first printing position and the cutting position is equal to a length of the printing medium from a point at which the cutting unit is to cut the printing medium to a next printing start point, and wherein, after the first printing unit ends printing, the first rotation unit is controlled by the control unit, to convey the printing medium in the first direction until the point on the printing medium at which the cutting unit is to cut the printing medium coincides with the cutting position, and to keep the printing medium immobile until the first printing unit starts the next printing on the printing medium from which the printing medium strip has been cut apart by the cutting unit.

3. The printing device according to claim 1, wherein a distance between the cutting position and the second printing position is equal to a length of the printing medium from a point at which the second printing unit starts printing on the printing medium to a point at which the cutting unit cuts the printing medium, and wherein the second rotation unit is controlled by the control unit, to convey the printing medium until the point on the printing medium nipped at which the cutting unit is to cut the printing medium coincides with the cutting position, and to keep the printing medium and the printing medium strip immobile until the second printing unit starts printing on the printing medium strip which has been cut apart from the printing medium by the cutting unit.

4. The printing device according to claim 1, wherein the second printing unit has a printing head to perform printing on the printing medium strip, and wherein the second rotation unit and the printing head of the second printing unit are controlled by the control unit, to nip the printing medium and the printing medium strip.

5. The printing device according to claim 1, further comprising:

a third rotation unit controlled by the control unit, to nip the printing medium at a predetermined third nip position, on the convey path, located between the first printing position and the cutting position, and to convey the printing medium by rotating, the third rotation unit serving to nip the printing medium conveyed by the first rotation unit, serving to convey the printing medium nipped by the third rotation unit and the first rotation unit in the first direction until a point on the printing medium at which the cutting unit is to cut the printing medium coincides with the cutting position, serving to stop rotation, and serving to fix the printing medium at the third nip position, wherein a distance between the first printing position and the cutting position is shorter than a length of the printing medium from a point at which the cutting unit is to cut the printing medium to a next printing start point, and wherein, after the third rotation unit fixes the printing medium at the third nip position, the first rotation unit is controlled by the control unit, to keep conveying the printing medium in the first direction, so that a slack is generated in the printing medium between the first printing position and the third nip position.

6. The printing device according to claim 5, wherein the third rotation unit is controlled by the control unit, to eliminate the slack generated in the printing medium between the first printing position and the third nip position by conveying the printing medium, from which the printing medium strip has been cut apart by the cutting unit, in the first direction, and wherein the first printing unit is controlled by the control unit, to perform the next printing on the printing medium from which the slack generated between the first printing position and the third nip position has been eliminated.

7. The printing device according to claim 1, further comprising:

a third rotation unit controlled by the control unit, to nip a portion of the printing medium which is to become the printing medium strip upon being cut by the cutting unit, at a third nip position, on the convey path, located between the cutting position and the second printing position, and to convey, by rotating, the printing medium and the printing medium strip cut apart from the printing medium by the cutting unit, the third rotation unit serving to convey the printing medium nipped by the third rotation unit and the first rotation unit in the first direction until a point on the printing medium at which the cutting unit is to cut the printing medium coincides with the cutting position, serving to stop rotation, and serving to fix the printing medium at the third nip position, wherein a distance between the cutting position and the second printing position is shorter than a length of the printing medium from a point at which the second printing unit starts printing to a point at which the cutting unit is to cut the printing medium, and wherein the second rotation unit is controlled by the control unit, to convey the printing medium until the point on the printing medium at which the second printing unit starts printing coincides with the second printing position, to stop rotation before the third rotation unit fixes the printing medium at the third nip position, and to fix the printing medium at the second nip position, so that a slack is generated in the printing medium between the third nip position and the second printing position.

8. The printing device according to claim 7, wherein the second printing unit is controlled by the control unit, to start printing on a portion of the printing medium which is to become the printing medium strip upon being cut by the cutting unit after being fixed by the second rotation unit, and wherein the second rotation unit is controlled by the control unit, to convey the printing medium and the printing medium strip cut apart from the printing medium by the cutting unit, at a speed lower than a speed with which the fourth rotation unit conveys the printing medium, after the second printing unit starts printing until a point on the printing medium strip cut apart from the printing medium by the cutting unit, at which the second printing unit ends printing by the cutting unit coincides with the second printing position.

9. The printing device according to claim 1, further comprising:

a third rotation unit controlled by the control unit, to nip the printing medium at a predetermined third nip position, on the convey path, located between the first printing position and the cutting position, and to convey the printing medium by rotating, the third rotation unit serving to nip the printing medium conveyed by the first rotation unit, serving to convey the printing medium nipped by the third rotation unit and the first rotation unit in the first direction until a point on the printing medium at which the cutting unit is to cut the printing medium coincides with the cutting position, serving to stop rotation, and serving to rotate in a direction to convey the printing medium in the second direction; and a fourth rotation unit controlled by the control unit, to nip a portion of the printing medium which is to become the printing medium strip upon being cut by the cutting unit, at a predetermined fourth nip position, on the convey path, located between the cutting position and the second printing position, and to convey, by rotating, the printing medium and the printing medium strip cut apart from the printing medium by the cutting unit, the fourth rotation unit serving to convey the printing medium nipped by the fourth rotation unit, the first rotation unit, and the third rotation unit, in the first direction until a point on the printing medium at which the cutting unit is to cut the printing medium coincides with the cutting position, stop rotation, and when the third rotation unit rotates in a direction to convey the printing medium in the second direction, the fourth rotation unit serving to simultaneously rotate in a direction to convey the printing medium in the first direction, so that the printing medium is fixed in a state under a prescribed tension at a position between the third nip position and the fourth nip position, wherein the cutting unit cuts the printing medium which is fixed in a state under a prescribed tension applied by the third rotation unit and the fourth rotation unit.

10. The printing device according to claim 1, further comprising a margin cutting unit controlled by the controlled unit, to cut a margin from the printing medium strip on which the printing is performed by the second printing unit.

11. The printing device according to claim 1 performs the printing either on a recording paper or a roll paper.

12. The printing device according to claim 1, wherein the first printing unit is controlled by the control unit, to perform a color printing.

13. A printing device for performing printing by a plurality of printing steps, the printing device comprising:

a first printing unit to perform printing by a first printing step on a printing medium;

a first rotation unit to nip a printing medium, and to convey the printing medium nipped by rotating;

a cutting unit to cut a portion on which the printing is performed by the first printing unit from the printing medium, as a printing medium strip;

a second printing unit to perform an overcoat printing process by a second printing step on the printing medium strip cut by the cutting unit;

a second rotation unit to nip the printing medium, to nip a printing medium strip cut by the cutting unit from the printing medium nipped, and to convey the printing medium nipped and the printing medium strip nipped by rotating; and a control unit to determine whether or not the printing on the printing medium is for a last one piece, wherein the first printing unit performs the printing by the first printing step on the printing medium conveyed by the first rotation unit, wherein the cutting unit cuts a portion on which the printing is performed by the first printing unit from the printing medium conveyed by the first rotation unit and the second rotation unit, as the printing medium strip, wherein the second printing unit performs the printing by the second printing step on the printing medium strip cut by the cutting unit and conveyed by the second rotation unit, wherein the first rotation unit, when the control unit determines that the printing on the printing medium is for the last one piece, conveys the printing medium to the second printing position after the first printing unit completes the printing on the printing medium, and when the control unit determines that the printing on the printing medium is not for the last one piece, conveys the printing medium to the cutting position after the first printing unit completes the printing on the printing medium, wherein the cutting unit cuts the printing medium strip from the printing medium when the control unit determines that the printing on the printing medium is not for the last one piece, and wherein the second rotation unit, when the control unit determines that the printing on the printing medium is for the last one piece, nips the printing medium conveyed to the second printing position by the first rotation unit, and conveys the printing medium in a same direction as a direction for conveying the printing medium after the second printing unit starts printing on the printing medium, and when the control unit determines that the printing on the printing medium is not for the last one piece, nips the printing medium conveyed to the cutting position by the first rotation unit, and conveys the printing medium strip in a same direction as a direction for conveying the printing medium strip after the second printing unit starts printing on the printing medium strip cut by the cutting unit from the printing medium.

14. A printing method of performing printing with a printing device including a first rotation unit to nip, at a predetermined first nip position of a convey path for an elongated printing medium, the printing medium, and to convey the printing medium by rotating; a first printing unit to perform printing on the printing medium at a predetermined first printing position located in a first direction, with respect to the first nip position, to convey the printing medium; a cutting unit to cut the printing medium at a predetermined cutting position located in the first direction with respect to the first printing position, so as to cut apart a portion of the printing medium on which the first printing unit performs printing, as a printing medium strip; a second printing unit to perform an overcoat printing process on the printing medium strip at a predetermined second printing position located in the first direction with respect to the cutting position; and a second rotation unit to nip the printing medium and the printing medium strip at a predetermined second nip position located in the first direction with respect to the second printing position, and to convey the printing medium and the printing medium strip by rotating, the printing method comprising:

conveying, with the first rotation unit, the printing medium in the first direction until a printing start point on the printing medium coincides with the first printing position;

starting printing, with the first printing unit, on the printing medium conveyed by the first rotation unit;

conveying, with the first rotation unit, the printing medium on which the first printing unit performs printing, in a second direction opposite to the first direction until a printing end point on the printing medium coincides with the first printing position;

after the first printing unit ends the printing on the printing medium, with the first rotation unit, conveying the printing medium for which the first printing unit has ended printing, in the first direction;

nipping, with the second rotation unit, a portion of the printing medium for which the first printing unit ends printing and which is conveyed by the first rotation unit, the portion becoming the printing medium strip upon being cut by the cutting unit;

conveying, with the first rotation unit and the second rotation unit, the printing medium in the first direction until the point on the printing medium nipped at which the cutting unit is to cut the printing medium coincides with the cutting position;

cutting apart, with the cutting unit, the printing medium strip from the printing medium that has been conveyed by the first rotation unit and the second rotation unit;

starting printing, with the second printing unit, on the printing medium strip that has been cut apart by the cutting unit, in parallel with a next printing performed by the first printing unit on the printing medium from which the printing medium strip has been cut apart by the cutting unit; and conveying, with the second rotation unit, the printing medium strip, on which the second printing unit performs printing, in the first direction.

15. The printing method according to claim 14, wherein the printing device further includes a third rotation unit to nip the printing medium at a predetermined third nip position, on the convey path, located between the first printing position and the cutting position, and to convey the printing medium by rotating, and a fourth rotation unit to nip a portion of the printing medium which is to become the printing medium strip upon being cut by the cutting unit, at a predetermined fourth nip position, on the convey path, located between the cutting position and the second printing position, and to convey, by rotating, the printing medium nipped and the printing medium strip cut apart from the printing medium by the cutting unit, the first printing position and the cutting position being spaced apart from each other by a distance shorter than a length on the printing medium from a point at which the cutting unit is to cut the printing medium to a next printing start point, and the printing method further comprises:

nipping, with the third rotation unit, the printing medium for which the first printing unit has ended printing and which is conveyed by the first rotation unit, conveying, with the first rotation unit and the third rotation unit, the printing medium nipped, in the first direction, nipping, with the fourth rotation unit, a portion of the printing medium conveyed by the first rotation unit and the third rotation unit, the portion becoming the printing medium strip upon being cut by the cutting unit, conveying, with the first rotation unit, the third rotation unit, and the fourth rotation unit, the printing medium in the first direction until a point on the printing medium nipped, at which the cutting unit is to cut the printing medium coincides with the cutting position, stopping rotation of the third rotation unit and the fourth rotation unit, rotating the third rotation unit, in a direction to convey the printing medium in the second direction, and the fourth rotation unit, in a direction to convey the printing medium in the first direction, simultaneously, so that the printing medium is fixed in a state under a prescribed tension between the third nip position and the fourth nip position, and cutting, with the cutting unit, the printing medium which is fixed in a state under the prescribed tension applied by the third rotation unit and the fourth rotation unit.

16. The printing method according to claim 14, wherein the printing device includes a third rotation unit to nip the printing medium at a predetermined third nip position, on the convey path, located between the first printing position and the cutting position, and to convey the printing medium by rotating, and the printing method further comprises:

nipping, with the third rotation unit, the printing medium for which the first printing unit has ended printing and which is conveyed by the first rotation unit;

conveying, with the first rotation unit and the third rotation unit, the printing medium nipped, in the first direction; and when a point on the printing medium conveyed at which the cutting unit is to cut the printing medium coincides with the cutting position, fixing the printing medium at the third nip position by stopping rotation of the third rotation unit, and with the first rotation unit, keeping conveying the printing medium in the first direction, so that a slack is generated in the printing medium between the first printing position and the third nip position.

17. The printing method according to claim 16, further comprising:

conveying, with the third rotation unit, the printing medium from which the printing medium strip has been cut apart by the cutting unit, in the first direction, so that the slack generated in the printing medium between the first printing position and the third nip position is eliminated; and performing, with the first printing unit, a next printing on the printing medium from which the slack generated between the first printing position and the third nip position has been eliminated.

18. The printing method according to claim 14, wherein the printing device includes a third rotation unit to nip a portion of the printing medium which is to become the printing medium strip upon being cut by the cutting unit, at a third nip position, on the convey path, located between the cutting position and the second printing position, and to convey, by rotating, the printing medium and the printing medium strip cut apart from the printing medium by the cutting unit, the cutting position and the second printing position being spaced apart by a distance shorter than a length on the printing medium from a point at which the second printing unit starts printing to a point at which the cutting unit is to cut the printing medium, and the printing method further comprises:

nipping, with the third rotation unit, a portion of the printing medium conveyed by the first rotation unit, the portion becoming the printing medium strip upon being cut by the cutting unit;

conveying, with the first rotation unit and the third rotation unit, the printing medium nipped, in the first direction;

nipping, with the second rotation unit, the printing medium conveyed by the first rotation unit and the third rotation unit; and conveying, with the first rotation unit, the third rotation unit, and the second rotation unit, the printing medium nipped, in the first direction, and when a point on the printing medium conveyed at which the second printing unit is to start printing coincides with the second printing position, with the second rotation unit, stopping rotation and fixing the printing medium at the second nip position, and with the first rotation unit and the third rotation unit, keeping conveying the printing medium in the first direction, so that a slack is generated in the printing medium between the third nip position and the second printing position.

19. The printing method according to claim 14, wherein a distance between the first printing position and the cutting position is equal to a length of the printing medium from a point at which the cutting unit is to cut the printing medium to a next printing start point, and the printing method further comprises:

conveying, with the first rotation unit, the printing medium in the first direction, after the printing by the first printing unit is ended, until a point on the printing medium at which the cutting unit is to cut the printing medium coincides with the cutting position, and keeping the printing medium immobile until the first printing unit starts next printing on the printing medium from which the printing medium strip has been cut apart by the cutting unit.

20. The printing method according to claim 14, wherein a distance between the cutting position and the second printing position is equal to a length of the printing medium from a point at which the second printing unit is to start printing on the printing medium to a point at which the cutting unit is to cut the printing medium, and the printing method further comprises:

conveying, with the second rotation unit, the printing medium until a point on the printing medium nipped, at which the cutting unit is to cut the printing medium coincides with the cutting position, and keeping the printing medium and the printing medium strip immobile until the second printing unit starts printing on the printing medium strip cut apart from the printing medium by the cutting unit.

* * * * *